US007392670B2

(12) United States Patent
Maeda

(10) Patent No.: US 7,392,670 B2
(45) Date of Patent: Jul. 1, 2008

(54) END YARN TREATMENT APPARATUS AND METHOD OF WEFT KNITTING MACHINE

(75) Inventor: Hiroshi Maeda, Wakayama (JP)

(73) Assignee: Shima Seiki Manufacturing Limited, Wakayama-Shi, Wakayama (JP)

( * ) Notice: Subject to any disclaimer, the term of this patent is extended or adjusted under 35 U.S.C. 154(b) by 284 days.

(21) Appl. No.: 10/572,206

(22) PCT Filed: Sep. 17, 2004

(86) PCT No.: PCT/JP2004/013624

§ 371 (c)(1),
(2), (4) Date: Mar. 17, 2006

(87) PCT Pub. No.: WO2005/028726

PCT Pub. Date: Mar. 31, 2005

(65) Prior Publication Data

US 2006/0254400 A1 Nov. 16, 2006

(30) Foreign Application Priority Data

Sep. 19, 2003 (JP) ..... 2003-327759

(51) Int. Cl.
*D04B 35/00* (2006.01)

(52) U.S. Cl. ..... 66/145 B; 66/140 R; 66/142

(58) Field of Classification Search ..... 66/60 R, 66/64, 65, 75.1, 125 R, 126 R, 134, 140 R, 66/145 R, 145 B
See application file for complete search history.

(56) References Cited

U.S. PATENT DOCUMENTS 2,377,729 A * 6/1945 Toone et al. ..... 66/134
4,204,414 A * 5/1980 Vinnemann et al. ..... 66/145 R
4,364,246 A * 12/1982 Leins et al. ..... 66/145 R
4,559,792 A * 12/1985 Leins ..... 66/125 R
5,588,311 A 12/1996 Kiribuchi
6,058,742 A * 5/2000 Dalmau Guell ..... 66/140 R
6,119,486 A 9/2000 Morita et al.

FOREIGN PATENT DOCUMENTS

DE 4407708 9/1995

(Continued)

OTHER PUBLICATIONS

ISR dated Dec. 14, 2004.

*Primary Examiner*—Danny Worrell
(74) *Attorney, Agent, or Firm*—Harness, Dickey & Pierce

(57) ABSTRACT

First and second grippers are moveable in the longitudinal direction along needle beds of the weft knitting machine and in a direction that is closer to and away from a needle bed gap of the needle beds, switchable between a state of not holding a yarn and a state of holding the yarn, and moveable independently of each other. A cutter for cutting the yarn is provided on the first gripper. A control section controls the movements and the switching of the states of the first and second grippers, and the cutter so that in a state where the yarn is held by the first gripper and the second gripper, the held yarn is cut with the cutter. The end yarns generated by cutting the yarn with the cutter are not left in cut state, but treated by the first gripper and the second gripper independently of each other.

8 Claims, 22 Drawing Sheets

FOREIGN PATENT DOCUMENTS

| | | | |
|---|---|---|---|
| JP | 48-24421 | B1 | 7/1973 |
| JP | B 48-24421 | | 7/1973 |
| JP | 49-111 | B1 | 1/1974 |
| JP | B-49-111 | | 1/1974 |
| JP | B2 54-21464 | | 7/1979 |
| JP | 64-014352 | | 1/1989 |
| JP | 1-51574 | B2 | 11/1989 |
| JP | 02-269848 | | 11/1990 |
| JP | 03-220348 | | 9/1991 |
| JP | 4-74463 | B2 | 11/1992 |
| JP | 08-127948 | | 5/1996 |
| JP | U 3028923 | | 7/1996 |
| JP | 08-325901 | | 12/1996 |
| JP | 8-325901 | A | 12/1996 |
| JP | 09-087946 | | 3/1997 |
| JP | 9-87946 | A | 3/1997 |
| JP | 09-268455 | | 10/1997 |
| JP | 2000-178861 | | 6/2000 |
| JP | 3347079 | B2 | 11/2002 |

* cited by examiner

10

11
12
56
56
22
22
53
56a
53
21
54
54c
54
21
55
55
59
59
50
50
13
54a
54a
53a
53a
16b
16a
15a

END YARN TREATMENT APPARATUS AND METHOD OF WEFT KNITTING MACHINE

TECHNICAL FIELD

The present invention relates to an end yarn treatment apparatus and method of a weft knitting machine, for treating end yarns generated by cutting a crossing yarn in knitting a fabric with the weft knitting machine.

BACKGROUND ART

Conventionally, in weft knitting machines, fabrics have been knitted as various product patterns. FIG. 22 shows a typical pattern of a knitted fabric as a glove 1. The glove 1 is constituted by finger pockets for each finger comprising a little finger portion 2*a*, a ring finger portion 2*b*, a middle finger portion 2*c*, an index finger portion 2*d*, and a thumb portion 3, a four finger body 4, a five finger body 5, and a wrist portion 6. When the glove 1 is knitted with a weft knitting machine provided with front and rear needle beds, for example, after the finger pockets of the little finger portion 2*a*, the ring finger portion 2*b*, the middle finger portion 2*c*, and the index finger portion 2*d* are knitted one after another, the four finger body 4 is knitted, and then the finger pocket of the thumb portion 3 is knitted, and the five finger body 5 and the wrist portion 6 are knitted. With respect to the finger pockets for each finger, for example, knitting is started from a tip end, and a portion up to a finger base, which is to be attached to the four finger portion 4, is knitted with tubular plain stitch using the front and rear needle beds. When the finger pocket is knitted up to the finger base, then the finger tip of the next finger pocket is knitted. At that time, in a case where a knitting yarn is not cut, crossing yarns 7*a*, 7*b*, and 7*c* as indicated by phantom lines are generated. After the knitting yarn that becomes the crossing yarn 7*a*, 7*b*, or 7*c* is cut, the end yarn treatment is performed on end yarns 8*a*, 8*b*, and 8*c* generated on the side of the knitted fabric of the glove 1 with respect to the cut point, and end yarns 9*a*, 9*b*, and 9*c* generated on the side of yarn feeding with a yarn feeder or the like.

In the end yarn treatment, for example, before starting to knit the finger pocket of the ring finger portion 2*b*, the crossing yarn 7*a* crossing from a knitting needle holding the knitted fabric of the finger pocket that is knitted as the little finger portion 2*a* to the yarn feeder is cut after being pulled in below a knitting port at which the front and rear needle beds are opposed to each other and knitting is performed by letting the knitting needles move back and forth. The end yarn treatment is performed by inserting each of the end yarns 8*a* and 9*a* generated by the cutting into the knitted fabric with air injection, for example (see Japanese Examined Patent Publication JP-B2 49-111(1974), for example). Furthermore, as another end yarn treatment, a treatment is also performed in which the end yarns 8*a*, 8*b*, and 8*c* on the side of the knitted fabric are not held, but the end yarns 9*a*, 9*b*, and 9*c* on the side of the yarn feeder are held, and after starting to knit the finger tip of the next ring finger portion 2*b*, the held end yarns 9*a*, 9*b*, and 9*c* are inserted into the finger pockets with air injection (see Japanese Examined Patent Publications JP-B2 48-24421 (1973) and JP-B2 1-51574(1989), for example).

A knitting port at which the front and rear needle beds face each other and knitting a fabric is carried out by letting the knitting needles move back and forth is also referred to as a needle bed gap. There is also an apparatus in which a gripper for pulling upward a crossing yarn generated between knitted fabrics from the position that is proximal to the needle bed gap toward the upper portion and for gripping the crossing yarn on the side of the yarn feeder is provided and the knitting yarn between the gripper and the knitting needle holding the knitted fabric is cut at the position (see Japanese Unexamined Patent Publication JP-A 8-325901(1996), for example). The knitting yarn is cut in a cut mechanism that is similar to scissors, and the gripper and the scissors are driven with a motor, which is same operation means. While an end yarn is held by the gripper and cut with the scissors, a free movement with a cushion of a torsion coil spring and a grip pressure are utilized.

There is also an apparatus in which a knitting yarn is cut below the needle bed gap, and the end yarn treatment is performed by hooking the knitting yarn on a hook above the needle bed gap (see Japanese Examined Patent Publication JP-B2 3347079, for example). An end yarn on the side of the finger base, of a yarn crossing from a knitting needle to the yarn feeder above the needle bed gap, such as a yarn crossing from the finger base to the finger tip that is to be knitted next, is released after the cutting.

With the methods for inserting an end yarn into a finger pocket with air as disclosed in JP-B2 49-111(1974), JP-B2 48-24421(1973), and JP-B2 1-51574(1989), it is difficult to reliably guide an end yarn into a finger pocket. A knitting yarn is elastic and a tensile force is also applied to the knitting yarn, and thus when the knitting yarn is cut off, the position of the end yarns is not stabilized. Since this is a treatment for unstabilized end yarns, the end yarns are irregularly knitted into the knitted fabric-that is being knitted, and thus the product becomes non-uniform.

In the end yarn treatment in JP-A 8-325901(1996), the distance between the cut position and the gripper is small, but the distance between the cut position and the knitting needle is large. In recent years, as the glove 1 as shown in FIG. 22, a hard yarn such as aramid fiber has been used in order to improve the protection performance. When cutting such a hard yarn, the blades of scissors slip and thus it is impossible to reliably perform the cutting. The end yarn on the side of the knitting needle after the cutting is left without any treatment after the cutting, and thus even when the end yarn is pulled into a finger pocket with an elastic force, the end yarn is only irregularly knitted into the knitted fabric, so that the treatment is different from product to product and becomes non-uniform. With respect to the end yarn on the side of the gripper, the yarn end is released at the position above the knitting needle, and thus the end yarn is irregularly knitted into the knitted fabric, and thus the product becomes non-uniform. Furthermore, the gripping of the knitting yarn with the gripper and the cutting with the scissors are driven with the same operation means, and while a yarn end is gripped with the gripper and cut with the scissors, a free movement with a torsion coil spring and a grip pressure are utilized, and thus a resisting force is applied to a support rod and a key of a gripper driving member in order to move the gripper driving block while keeping a state in which the yarn end is gripped, so that the durability and the stability are impaired.

In the end yarn treatment in Japanese Patent No. 3347079, when a yarn crossing from the finger base of the finger pocket that has been knitted to the finger tip that is to be knitted next is cut, the end yarn on the side of the finger base is left without any treatment after the cutting. Accordingly, there is a case in which the end yarn is irregularly knitted into with a knitting needle knitting the next finger pocket or a knitting needle knitting the body. There is a possibility that the end yarn that is hooked on the hook drops off the hook while the end yarn is cut in the lower portion of the needle bed gap and moves upward to be gripped with a yarn press.

DISCLOSURE OF INVENTION

It is an object of the invention to provide an end yarn treatment apparatus and method of a weft knitting machine, capable of reliably catching and cutting a crossing yarn generated in knitting a fabric and of appropriately treating end yarns after the cutting.

The invention is directed to an end yarn treatment apparatus of a weft knitting machine, for cutting a knitting yarn and for treating end yarns generated by cutting when front and rear needle beds face each other in the weft knitting machine and a fabric is knitted by letting knitting needles move back and forth, comprising:

a first gripper that can move in a direction along needle beds of a weft knitting machine and in a direction in which the first gripper moves closer to and away from a needle bed gap of the needle beds, and that can switch between a state in which a knitting yarn is not gripped and a state in which a knitting yarn is gripped;

a second gripper that can move independently of the first gripper in a direction along the needle beds of the weft knitting machine and in a direction in which the second gripper moves closer to and away from the needle beds, and that can switch between a state in which a knitting yarn is not gripped and a state in which a knitting yarn is gripped;

a cutter that can move along the needle beds of the weft knitting machine, and that can switch between a state in which a knitting yarn is cut and a state in which a knitting yarn is not cut; and control means for controlling movement and switching of the states of the first gripper, the second gripper and the cutter, and for performing a control such that in a state where a knitting yarn is gripped with the first gripper and the second gripper, the knitting yarn between gripped points is cut with the cutter.

Furthermore, the invention is characterized in that:

the cutter is provided on the first gripper, and the second gripper is provided with at least a part of driving mechanism for operating the cutter so as to cut a knitting yarn.

Furthermore, the invention is characterized in that at least one gripper among the first gripper and the second gripper is provided with a spring-biased gripper mechanism, comprising:

a hook member whose front end portion catches and hooks a knitting yarn extending from a knitted fabric, a press member for pressing a knitting yarn hooked on the hook member such that the knitting yarn is held and gripped with the press member together with the front end portion of the hook member, a spring for applying a force such that the press member is pressed toward the front end portion of the hook member, and a displacement mechanism for displacing the hook member in a direction in which the hook member moves closer to and away from the needle bed gap of the needle beds.

Furthermore, the invention is characterized in that, among the first gripper and the second gripper, the other gripper than the one gripper provided with the spring-biased gripper mechanism, is provided with a stopper for preventing the press member on a side opposed to the stopper on one side from moving closer to a position at which a knitting yarn is fed to the needle bed gap of the needle beds when the first gripper and the second gripper have moved closer to each other within a range of a predetermined distance.

Furthermore, the invention is characterized in that:

a pair of guide paths that are provided in parallel with each other along the needle bed gap of the needle beds and that guide movement of the first gripper and the second gripper along the needle beds, are provided, and one guide path and the other guide path among the pair of guide paths respectively drive the first gripper and the second gripper for movement in a direction in which the grippers move closer to and away from the needle bed gap of the needle beds with an angular displacement about an axis.

Furthermore, the invention is directed to an end yarn treatment method of a weft knitting machine, for cutting a knitting yarn and for treating end yarns generated by cutting in knitting a fabric with the weft knitting machine, comprising:

gripping both sides of a portion at which a knitting yarn is to be cut with a cutter, with two grippers; and treating end yarns generated after a knitting yarn is cut with the cutter by the grippers such that the end yarns are absorbed into a knitted fabric independently of each other.

Furthermore, the invention is characterized in that a knitting yarn is caught and gripped only when the two grippers have moved closer to each other within a range of a predetermined distance.

Furthermore, the invention is characterized in that a knitting yarn is cut by operating the cutter only when the two grippers grip the knitting yarn.

BRIEF DESCRIPTION OF DRAWINGS

Other and further objects, features, and advantages of the invention will be more explicit from the following detailed description taken with reference to the drawings wherein.

BEST MODE FOR CARRYING OUT THE INVENTION

Figure 1:
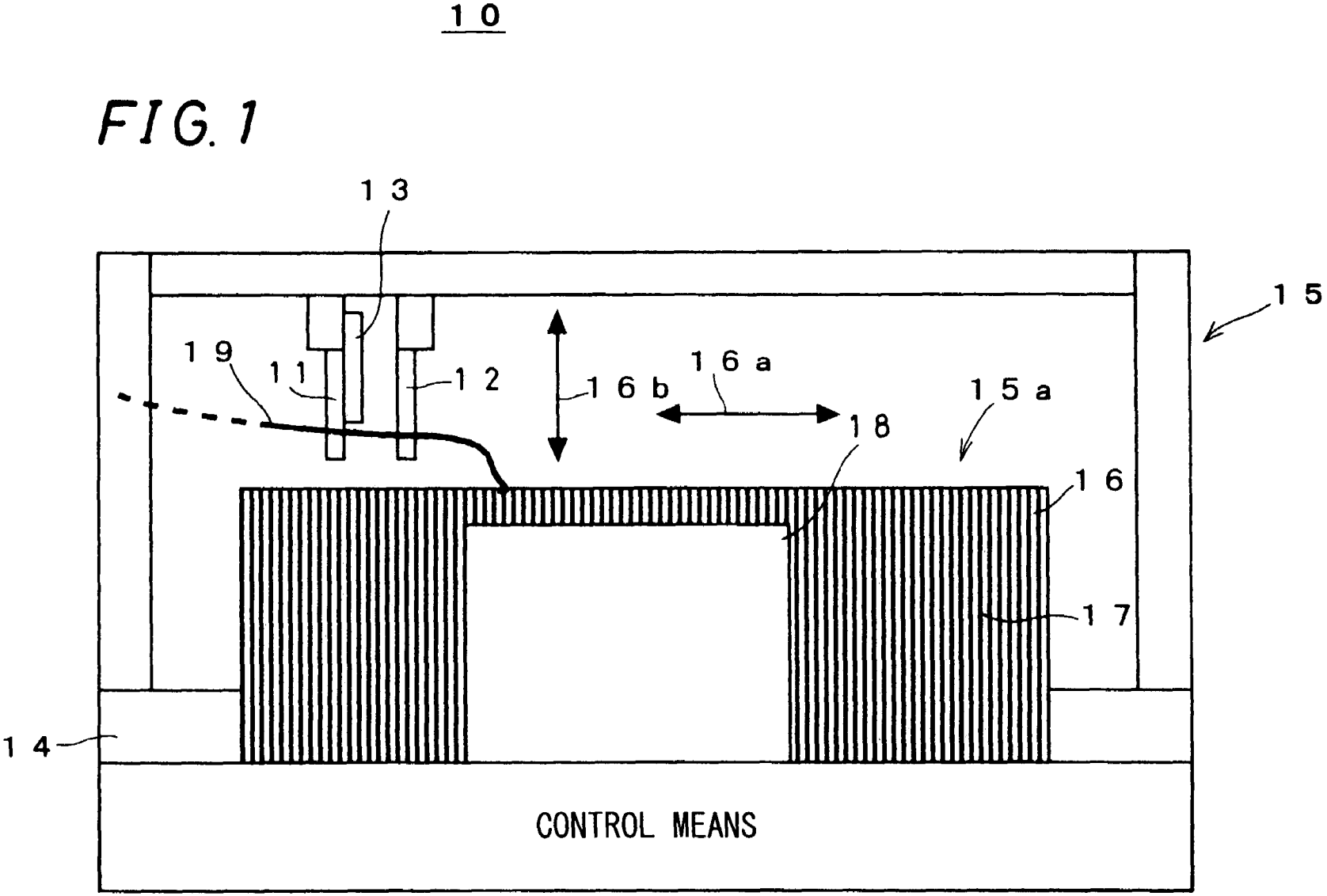
FIG. 1 is a front view illustrating a schematic overall configuration of an end yarn treatment apparatus 10 of the invention.

Now referring to the drawings, preferred embodiments of the invention are described below.

FIG. 1 shows a schematic configuration of an end yarn treatment apparatus 10, of a weft knitting machine according to one embodiment of the invention. The end yarn treatment apparatus 10 includes a first gripper 11, a second gripper 12, a cutter 13, and control means 14. In a weft knitting machine 15, a fabric is knitted with a plurality of knitting needles 17 that are arranged along a longitudinal direction 16*a* of needle beds 16. The weft knitting machine 15 is a V-shaped bed-type. The needle beds 16 are arranged as a pair of the front and the rear when viewed from the front, and the front and rear needle beds are opposed to each other at a needle bed gap 15*a* in the middle therebetween. Each of the needle beds 16 is inclined so as to be high on the side of the needle bed gap 15*a* and become lower as being away from the needle bed gap 15*a*. Knitting needles 17 perform a knitting operation by being selectively driven, for example, with a knitting cam mechanism mounted on carriages 18 that travel back and forth in the longitudinal direction 16*a* of the needle beds 16 such that the knitting needles 17 move forward into and backward from the needle bed gap 15*a*. A knitting yarn 19 is fed at the needle bed gap 15*a* to the knitting needles 17 that perform the knitting operation, and a knitted fabric is formed. While a fabric is knitted, in a case where the knitting yarn 19 becomes a crossing yarn, the end yarn treatment apparatus 10 cuts the knitting yarn 19 and treats the end yarns.

The first gripper 11 can move in the direction along the needle beds 16 of the weft knitting machine 15, that is, the longitudinal direction 16*a*, and the direction in which the first gripper 11 moves closer to and away from the needle bed gap 15*a* of the needle beds 16, that is, a general raising and lowering direction 16*b* above the needle bed gap 15*a*, and can switch between a state in which the knitting yarn 19 is not gripped and a state in which the knitting yarn 19 is gripped. The second gripper 12 can move independently of the first gripper 11 in the longitudinal direction 16*a* and the raising and lowering direction 16*b*, and can switch between a state in which the knitting yarn 19 is not gripped and a state in which the knitting yarn 19 is gripped. The cutter 13 can move in the longitudinal direction 16*a* and can switch between a state in which the knitting yarn 19 is cut and a state in which the knitting yarn 19 is not cut. The control means 14 controls the movement and the switching of the states of the first gripper 11, the second gripper 12, and the cutter 13, and performs a control such that in a state where the knitting yarn 19 is gripped with the first gripper 11 and the second gripper 12, the gripped knitting yarn 19 is cut with the cutter 13.

Figure 2:
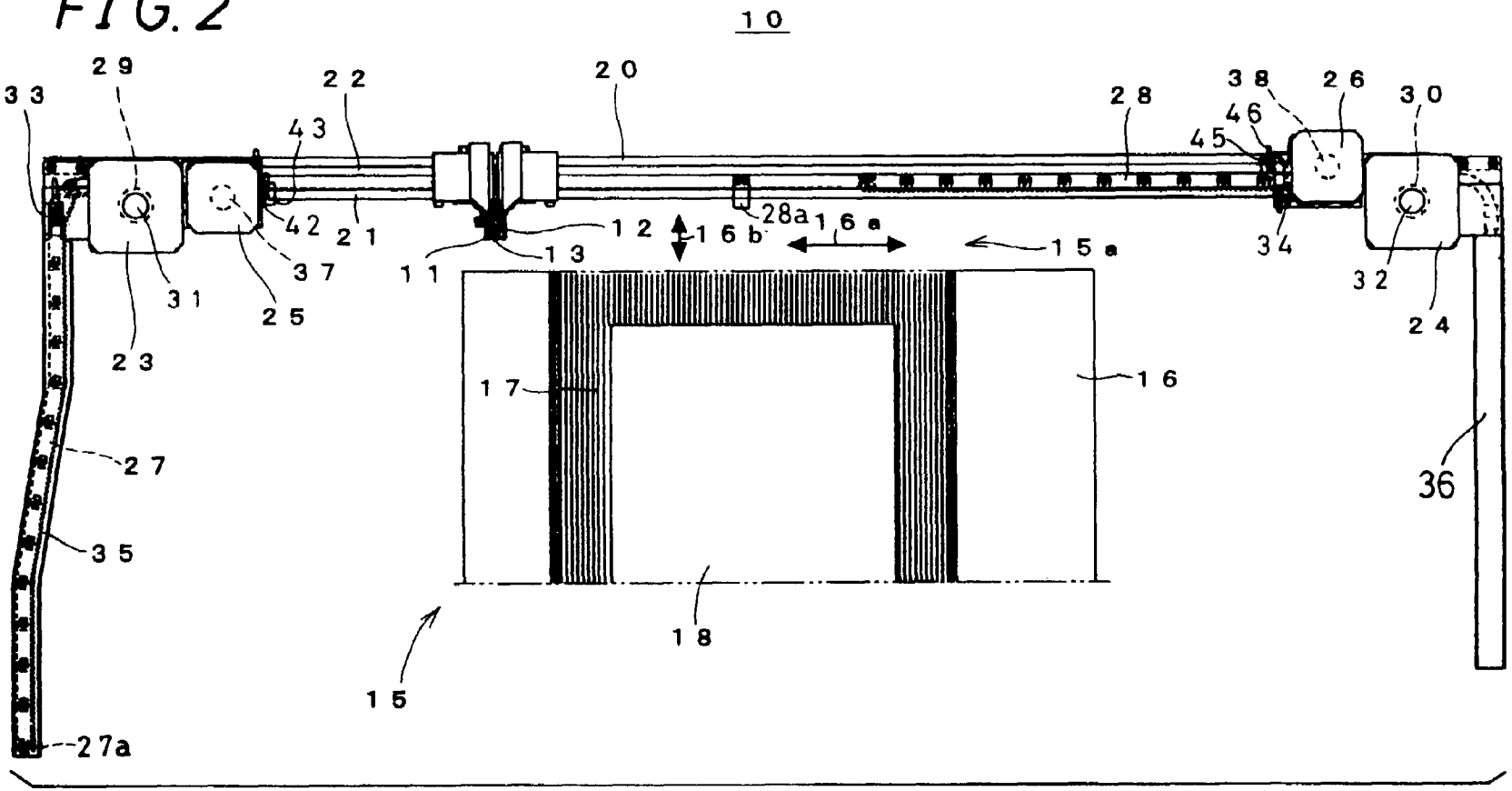
FIG. 2 is a front view illustrating a configuration for performing a drive in the end yarn treatment apparatus 10 in FIG. 1 in a state where a first gripper 11, a second gripper 12, and a cutter 13 are positioned at left end.
Figure 3:
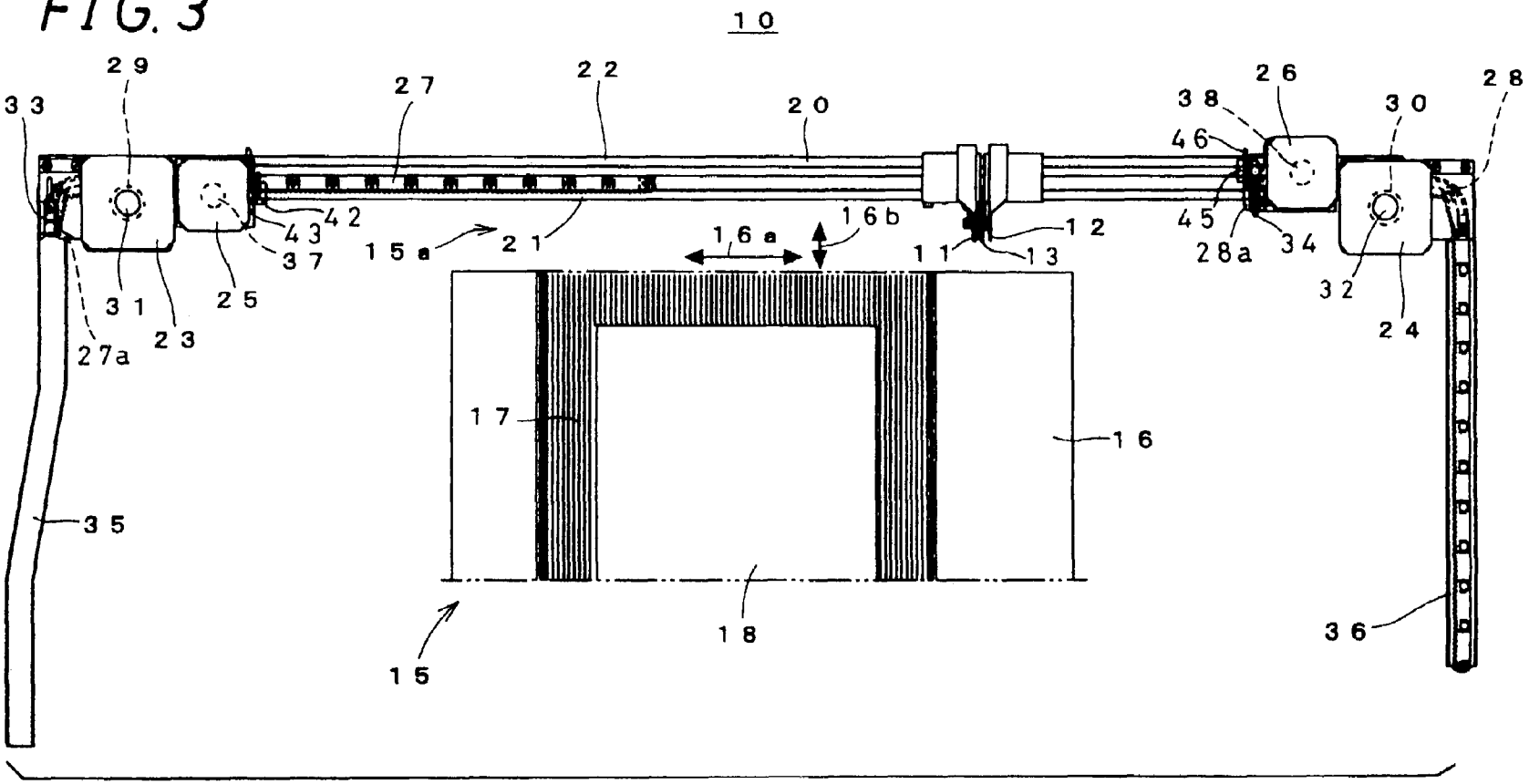
FIG. 3 is a front view illustrating a configuration for performing a drive in the end yarn treatment apparatus 10 in FIG. 1 in a state where the first gripper 11, the second gripper 12, and the cutter 13 are positioned at right end.

FIGS. 2 and 3 show a configuration for performing a drive in which the first gripper 11, the second gripper 12, and the cutter 13 in the end yarn treatment apparatus 10 shown in FIG. 1 are moved in the longitudinal direction 16*a* of the needle beds 16 and are moved in the closer and away direction 16*b* in which the first gripper 11, the second gripper 12, and the cutter 13 move closer to and away from the needle bed gap 15*a*. FIG. 2 shows a state in which the first gripper 11, the second gripper 12, and the cutter 13 have moved to the left side end of the needle beds 16. FIG. 3 shows a state in which the first gripper 11, the second gripper 12, and the cutter 13 have moved to the right side end of the needle beds 16.

In this embodiment, the cutter 13 and the first gripper 11 are combined and move as one piece in the longitudinal direction 16*a*. The first gripper 11 and the second gripper 12 move in the longitudinal direction 16*a*, taking a guide rail 20, a first driving shaft 21, a second driving shaft 22 that are stretched in parallel with the longitudinal direction 16*a* as common guide paths. With respect to these guide paths, the first gripper 11 is disposed on the left side when viewed from the front, and the second gripper 12 is disposed on the right side, for example. As a driving source for the movement in the longitudinal direction 16*a*, the first gripper 11 and the second gripper 12 are provided with a first movement motor 23 and a second movement motor 24 respectively on the left end side and the right end side of the guide rail 20. As a driving source for the movement of the first gripper 11 and the second gripper 12 in the closer and away direction 16*b*, a first rotation motor 25 and a second rotation motor 26 are provided respectively on the left end side and the right end side of the guide rail 20. In the configuration described below, the components relating to the first gripper 11 are arranged on the left side in the longitudinal direction 16*a*, and the components relating to the second gripper 12 are arranged on the right side in the longitudinal direction 16*a*, respectively.

The first movement motor 23 and the second movement motor 24 respectively move the first gripper 11 and the second gripper 12 via a first chain 27 and a second chain 28. A first pinion gear 29 and a second pinion gear 30 are respectively attached to output shafts of the first movement motor 23 and the second movement motor 24. Rack teeth that mesh with the first pinion gear 29 and the second pinion gear 30 are respectively formed on the first chain 27 and the second chain 28, and convert a rotation movement of the first movement motor 23 and the second movement motor 24 into a linear movement in the longitudinal direction 16*a*. The first gripper 11 and the second gripper 12 are respectively mounted on the vicinity on the right end side and on the vicinity on the left end side of the first chain 27 and the second chain 28. The amounts in which the first chain 27 and the second chain 28 are displaced are respectively detected with a first encoder 31 and a second encoder 32. A first detection member 27*a* and a second detection member 28*a* are respectively mounted on the left ends of the first chain 27 and the second chain 28. As the first detection member 27*a*, a link pin at the distal end of the chain 27 can be used, for example.

FIG. 2 shows the position obtained when each of the first gripper 11 and the second gripper 12 has moved to the left end, and the amounts in which the first chain 27 and the second chain 28 are displaced from reference positions are determined by the number of steps of the first movement motor 23 and the second movement motor 24, and are detected with the first encoder 31 and the second encoder 32, respectively. FIG. 3 shows a state in which the first gripper 11 and the second gripper 12 are respectively at the reference positions, and the first detection member 27*a* and the second detection member 28*a* are respectively detected with a first proximity sensor 33 and a second proximity sensor 34. The left end side and the right end side of the first chain 27 and the second chain 28 are bent and guided into a first chain accommodating gutter 35 and a second chain accommodating gutter 36 that extend downward. The first gripper 11 and the second gripper 12 are respectively driven with the first rotation motor 25 and the second rotation motor 26 via the first driving shaft 21 and the second driving shaft 22, by converting the direction of the rotation axes with a first conversion mechanism 37 and a second conversion mechanism 38. As the reference positions of the first driving shaft 21 and the second driving shaft 22, a first proximity part 42 and a second proximity part 45 are respectively detected with a first proximity part sensor 43 and a second proximity part sensor 46, but it is also possible to use only one set. The positions in the closer and away direction 16*b* of the first gripper 11 and the second gripper 12 from the needle bed gap 15*a* are determined by the number of steps of the first rotation motor 25 and the second rotation motor 26 from the reference positions.

A signal for driving each of the first movement motor 23, the second movement motor 24, the first rotation motor 25, and the second rotation motor 26 is output by the control means 14 in FIG. 1. Signals from the first encoder 31, the second encoder 32, the first proximity sensor 33, and the second proximity sensor 34 are input to the control means 14.

Figure 4:
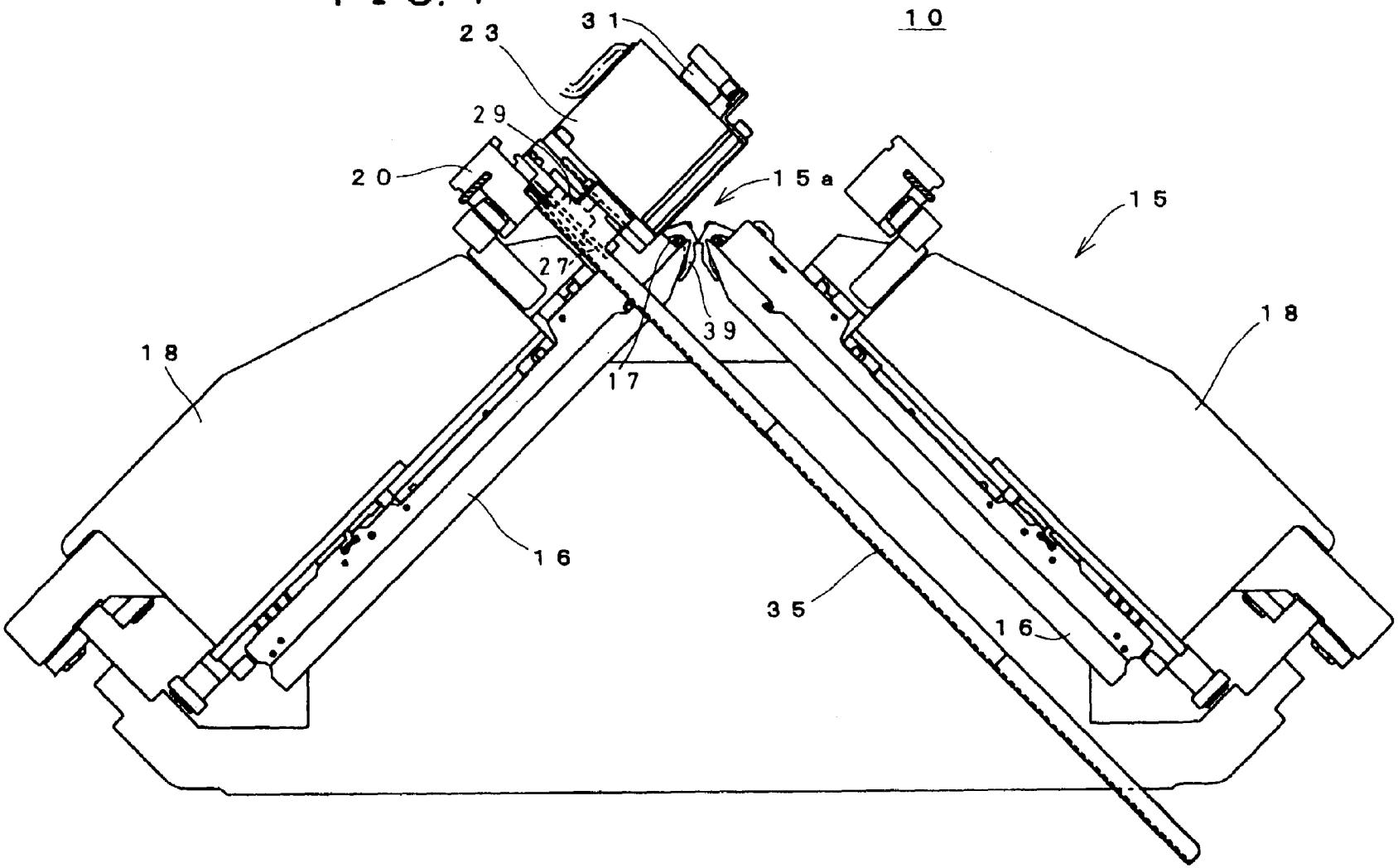
FIG. 4 is a left side view of FIGS. 2 and 3.
Figure 5:
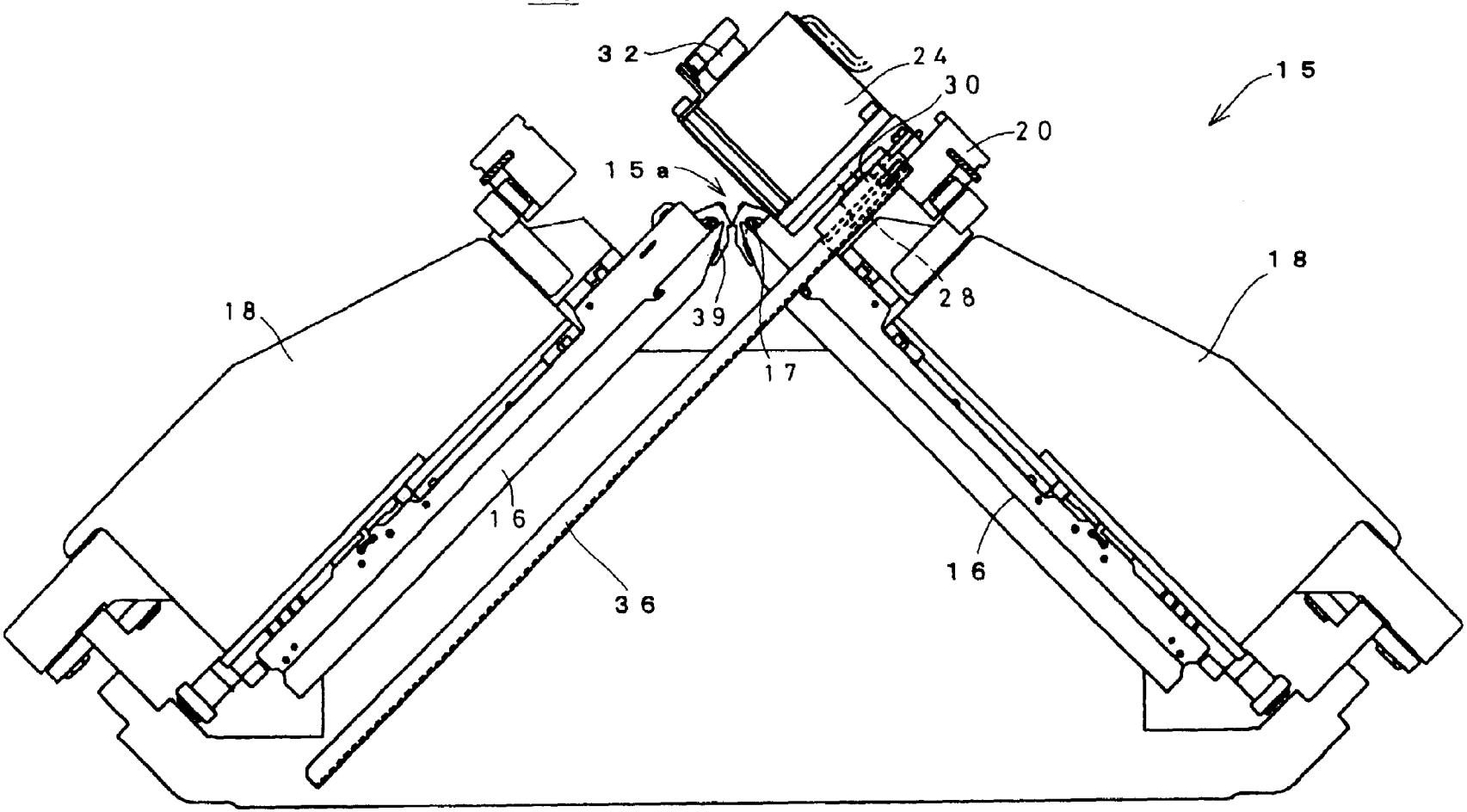
FIG. 5 is a right side view of FIGS. 2 and 3.

FIGS. 4 and 5 respectively show states in which the configuration of the end yarn treatment apparatus 10 in FIGS. 2 and 3 is viewed from the left side and the right side. The front ends of the knitting needles 17 from the front and rear needle beds 16 move forward into and backward from the needle bed gap 15*a* in accordance with a drive performed by the carriages 18, and sinkers 39 for pressing a knitted fabric that is being knitted are provided. End yarns are treated by the end yarn treatment apparatus 10 in such a manner that the treatment does not interfere with a knitting operation with the knitting needles 18 and the sinkers 39.

FIGS. 6 to 9 show the configuration relating the first gripper 11. The configuration relating to the second gripper 12 is basically similar to the configuration relating the first gripper 11 except that the shapes are generally bilaterally-symmetric. Furthermore, the first gripper 11 is provided also with the cutter 13 in FIG. 1, but the related portion is not shown for the sake of convenience.

Figure 6:
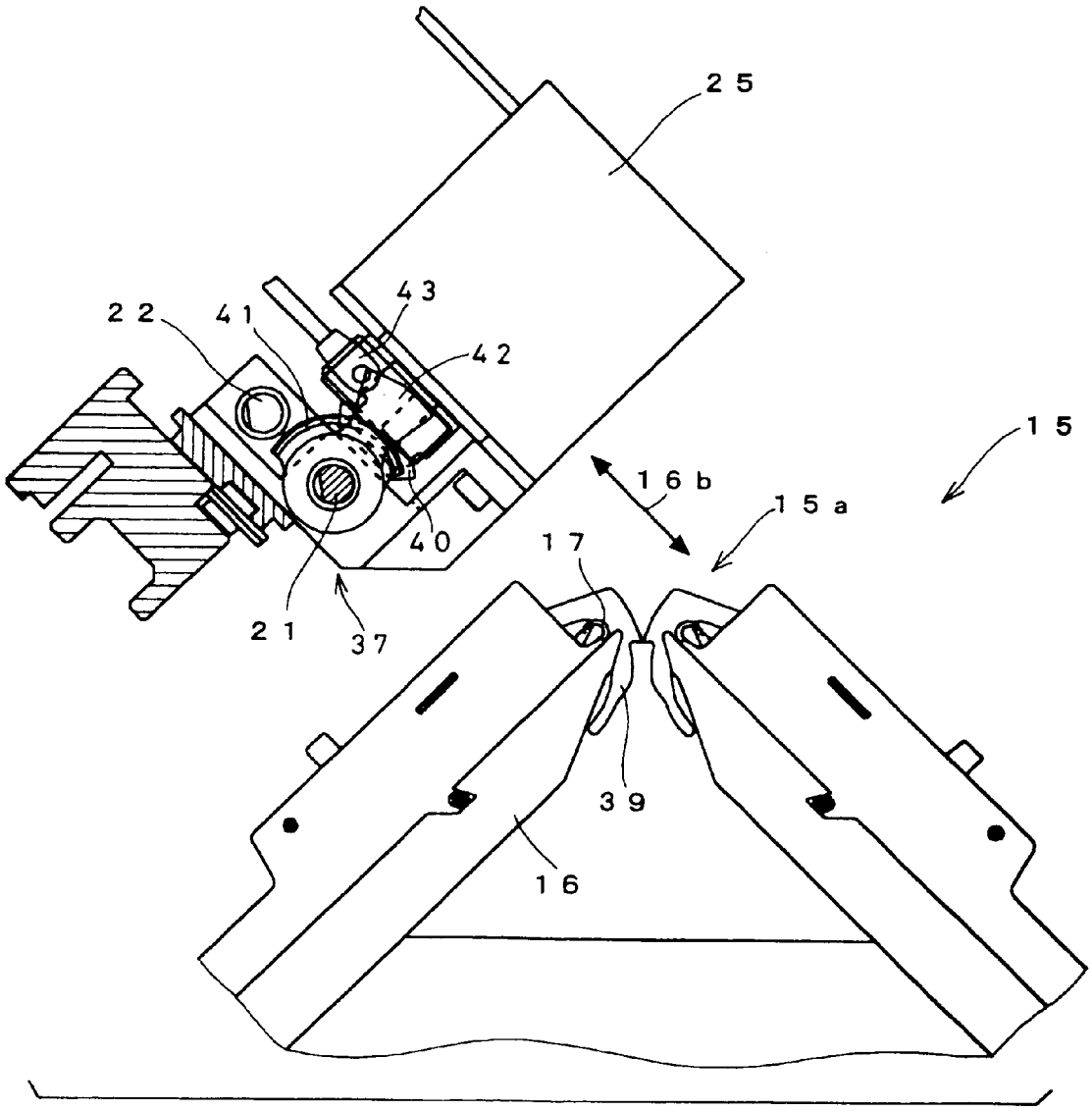
FIG. 6 is a left side cross-sectional view illustrating a configuration with respect to a driving source for driving the first gripper 11 in FIG. 1 in a closer and away direction 16*b;*

FIG. 6 shows the configuration with respect to the driving source for driving the first gripper 11 in the closer and away direction 16*b* in FIG. 1. The first conversion mechanism 37 includes a bevel gear 40 that is attached to an output shaft of the first rotation motor 25 and a partial bevel gear 41 that is attached to the first driving shaft 21. Instead of the partial bevel gear 41, a bevel gear in which teeth are formed throughout the circumference may be used, but it is sufficient that the first driving shaft 21 performs an angular displacement not greater than the half rotation, and thus the weight is reduced by using the partial bevel gear 41. Whether or not the first driving shaft 21 is at a reference angle is determined by detecting the first proximity part 42 that is attached to the first driving shaft 21 with the first proximity part sensor 43. A signal from the first proximity part sensor 43 is input to the control means 14 in FIG. 1.

Figure 7:
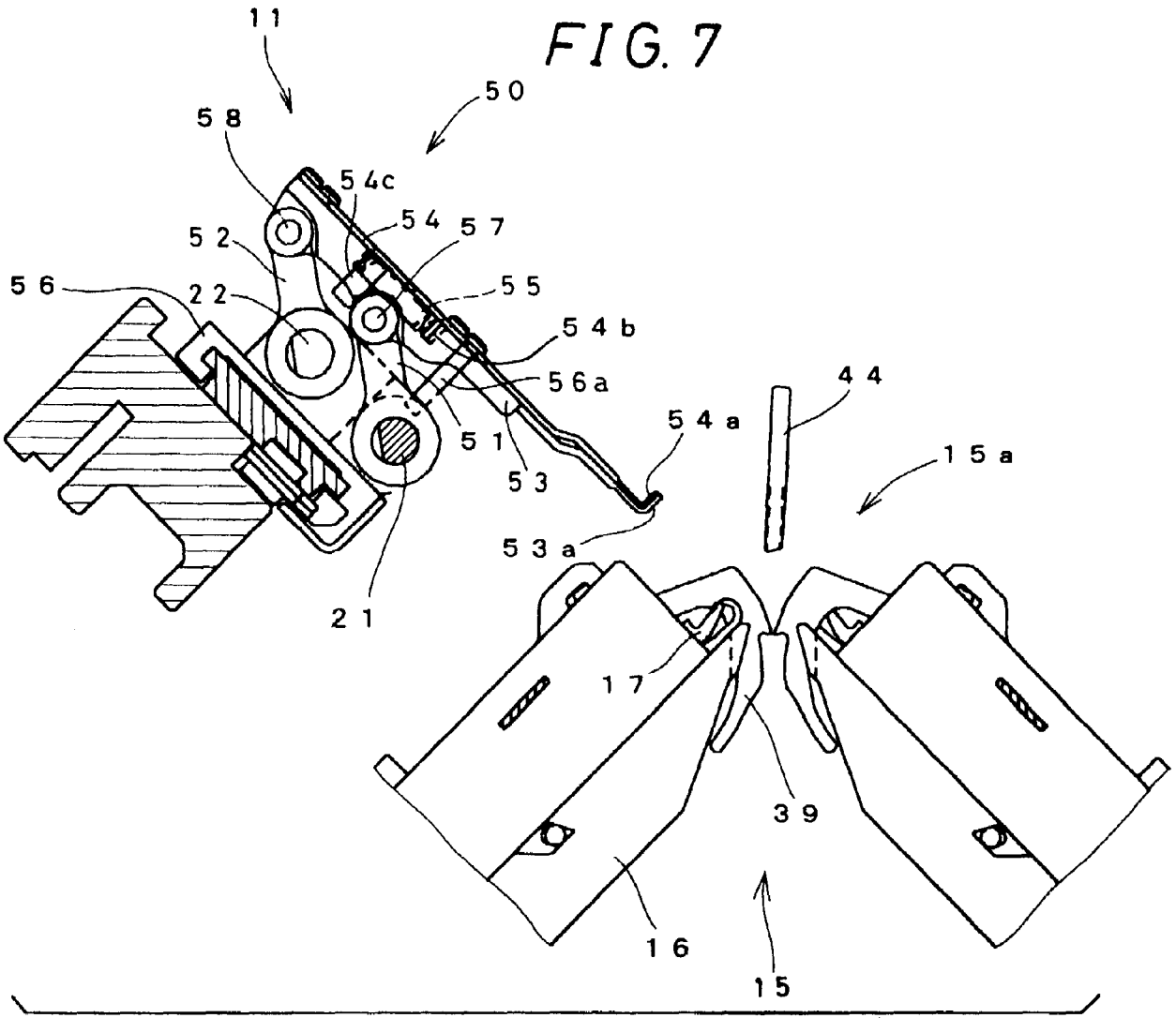
FIG. 7 is a left side cross-sectional view illustrating a state in which the first gripper 11 in FIG. 1 has moved away from a needle bed gap 15*a* to the extent possible.
Figure 8:
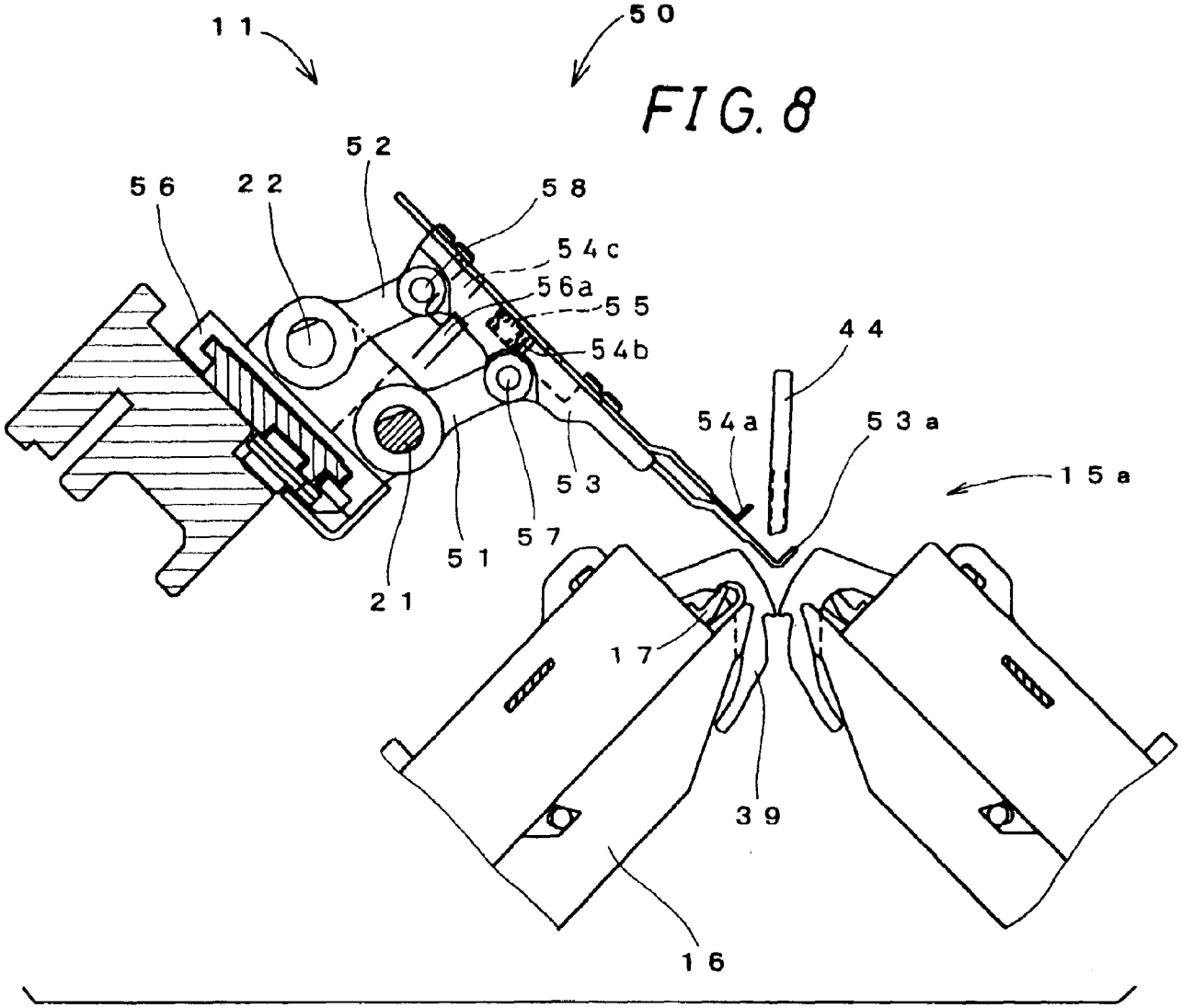
FIG. 8 is a left side cross-sectional view illustrating a state in which a front end portion of the first gripper 11 in FIG. 1 is open and has moved closest to the needle bed gap 15*a;*
Figure 9:
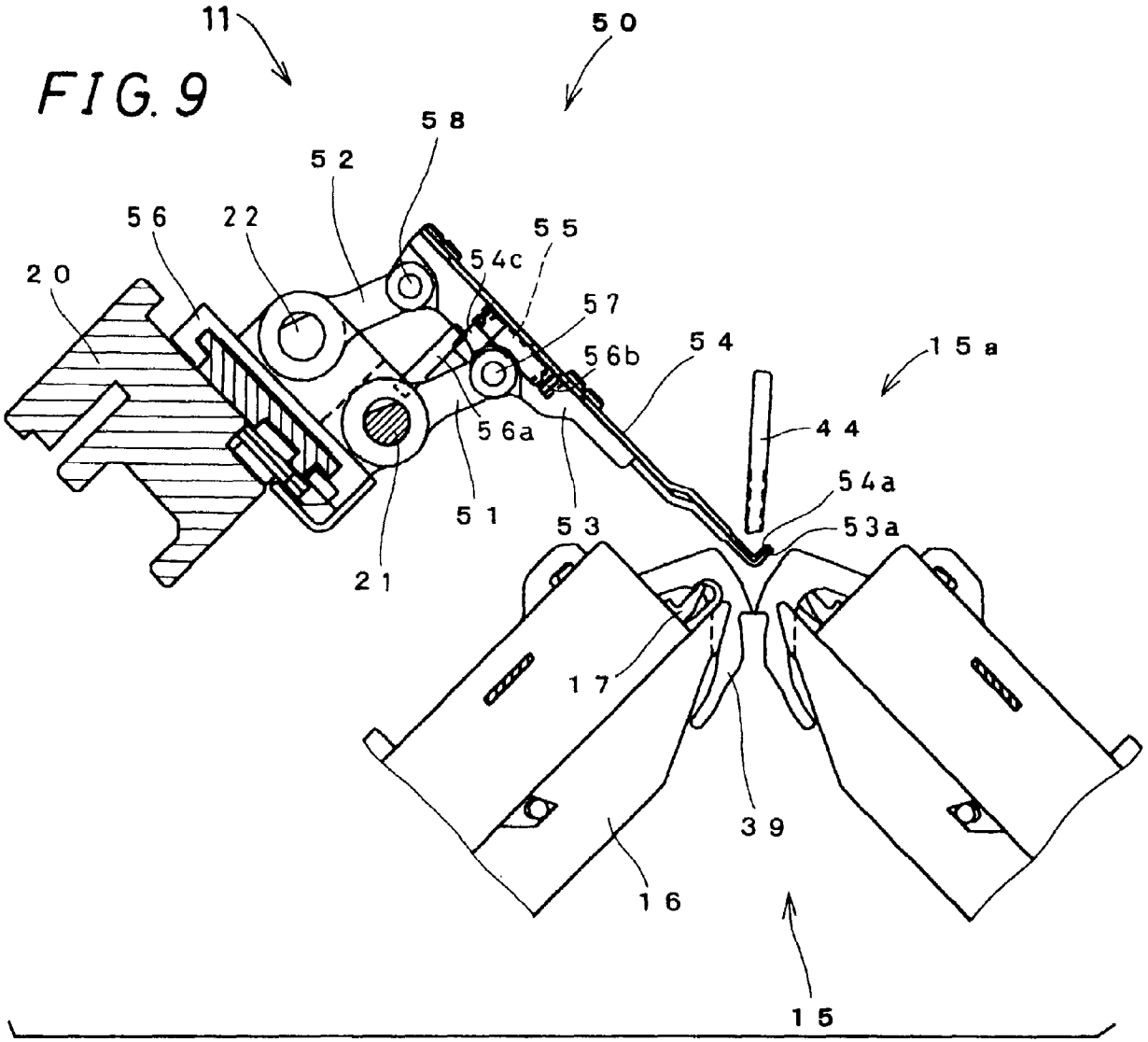
FIG. 9 is a left side cross-sectional view illustrating a state in which the front end portion of the first gripper 11 in FIG. 1 is closed and has moved closest to the needle bed gap 15*a;*

FIGS. 7, 8, and 9 show operation states of the first gripper 11 in the closer and away direction 16*b*. FIG. 7 shows a state in which the first gripper 11 has moved away from the needle bed gap 15*a* to the extent possible. The first proximity part sensor 43 in FIG. 6 can detect this remotest state by detecting the first proximity part 42. In this state, the front end portion of the first gripper 11 is sufficiently away from the knitting needles 17 and the sinkers 39 that act on the needle bed gap 15*a*, and a yarn feeding port 44 for feeding a knitting yarn to the needle bed gap 15*a*, and thus their operations are not interfered with. FIGS. 8 and 9 show states in which the first gripper 11 has moved closest to the needle bed gap 15*a*. Herein, while the front end portion of the first gripper 11 is open in FIG. 8, the front end portion is closed in FIG. 9.

Figure 10:
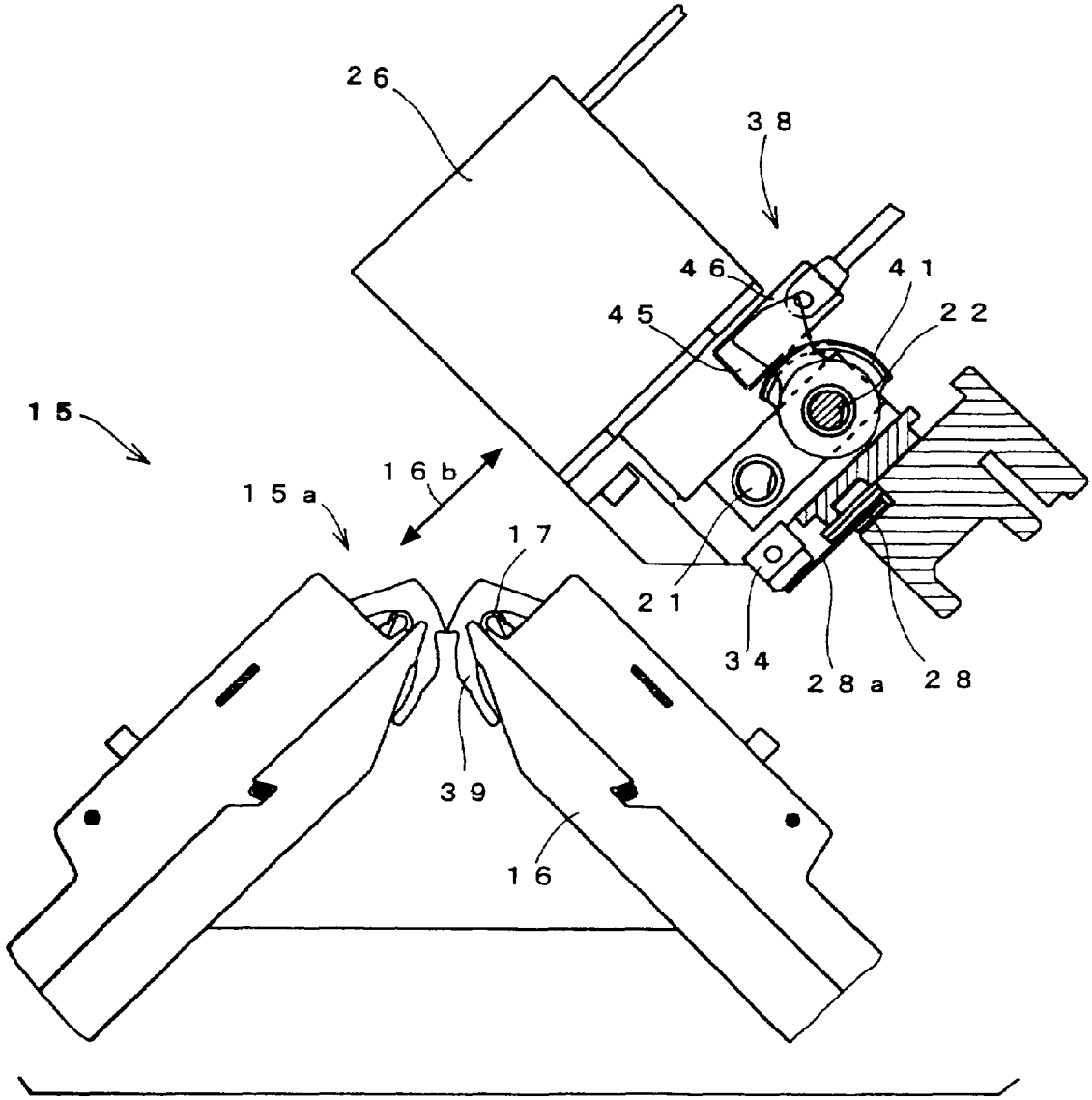
FIG. 10 is a right side cross-sectional view illustrating a configuration with respect to a driving source for driving the second gripper 12 in FIG. 1 in the closer and away direction 16*b;*

FIG. 10 shows the configuration with respect to the driving source for driving the second gripper 12 in the closer and away direction 16*b* in FIG. 1. In the second conversion mechanism 38, components corresponding to those in the first conversion mechanism 37 shown in FIG. 6 are denoted by the same reference symbols. When the second proximity part 45 that is attached to the second driving shaft 22 is detected with the second proximity part sensor 46, it is determined that the position is at the reference position. It should be noted that the second proximity sensor 34 detects the reference position of the second chain 28 by detecting the second detection member 28*a*.

The first gripper 11 and the second gripper 12 in this embodiment are configured as spring-biased grippers 50, and include a first link member 51, a second link member 52, a hook member 53, a press member 54, a spring 55, a base 56, a first connection pin 57, and a second connection pin 58. The front end portion of the spring-biased gripper 50 is constituted by a front end portion 53*a* of the hook member 53 and a front end portion 54*a* of the press member 54. The front ends of the first link member 51 and the second link member 52 are respectively connected to the hook member 53 with the first connection pin 57 and the second connection pin 58 such that the link members can be swingingly displaced. In the first gripper 11, the base end of the first link member 51 is linked to the first driving shaft 21 and the second driving shaft 52 is simply inserted into the base end of the second link member 52. In the second gripper 12, the base end of the second link member 52 is linked to the second driving shaft 22 and the first driving shaft 51 is simply inserted into the base end of the first link member 51.

The first driving shaft 21 and the second driving shaft 22 have a circular cross-section that is partially cut off in a straight line, that is, a bowed cross-section. When a through-hole whose cross-section is in the shape of a bow is formed at the base ends of the first link member 51 and the second link member 52, and the first driving shaft 21 or the second driving shaft 22 is fitted into the through-hole, a driving force can be transmitted with an angular displacement. When a through-hole whose cross-section is in the shape of a circle is formed at the base ends of the first link member 51 and the second link member 52, a driving force is not transmitted with an angular displacement. Depending on the shape of a through-hole provided on the side of the base ends of the first link member 51 and the second link member 52, it is possible to select the shaft to receive the transmitted driving force between the first driving shaft 21 and the second driving shaft 22.

A force is applied by the spring 55 to the press member 54 such that the front end portion 54*a* presses the front end portion 53*a* of the hook member 53. The spring 55 is a compression spring, is accommodated in a spring accommodating portion provided in the hook member 53, and presses a spring bearing portion 54*b* provided on the press member 54. When a knitting yarn is caught between the front end portion 53*a* of the hook member 53 and the front end portion 54*a* of the press member 54, it is possible to grip the knitting yarn by pressing the front end portion 54*a* of the press member 54 toward the front end portion 53*a* of the hook member 53 and thus closing between the front end portions 53*a* and 54*a*. The press member 54 is also provided with a projecting portion 54*c*. The projecting portion 54*c* of the press member 54 provided on one spring-biased gripper 50 abuts against a stopper 56*a* provided on the base 56 of the other spring-biased gripper 50, and thus the movement of the projecting portion 54*c* closer to the needle bed gap 15*a* is regulated.

FIG. 8 shows a state in which the first gripper 12 and the second gripper 12 have moved closer to each other, which is not shown, the movement of the press member 54 closer to the needle bed gap 15*a* is regulated, the hook member 53 has moved closest to the needle bed gap 15*a*, and the front end portion as the first gripper 11 is open widest. The position at which the press member 54 is regulated is the position that is away over the position at which a knitting yarn is fed from the yarn feeding port 44 to the needle bed gap 15*a*. However, this position is closer to the needle bed gap 15*a* than the position at which the cutter 13 cuts a knitting yarn, which is described below. When the regulation by the stopper 56*a* on the press member 54 is released, the front end portion of the spring-biased gripper 50 can be closed with a force applied by the spring 55, as shown in FIG. 9.

Figure 11:
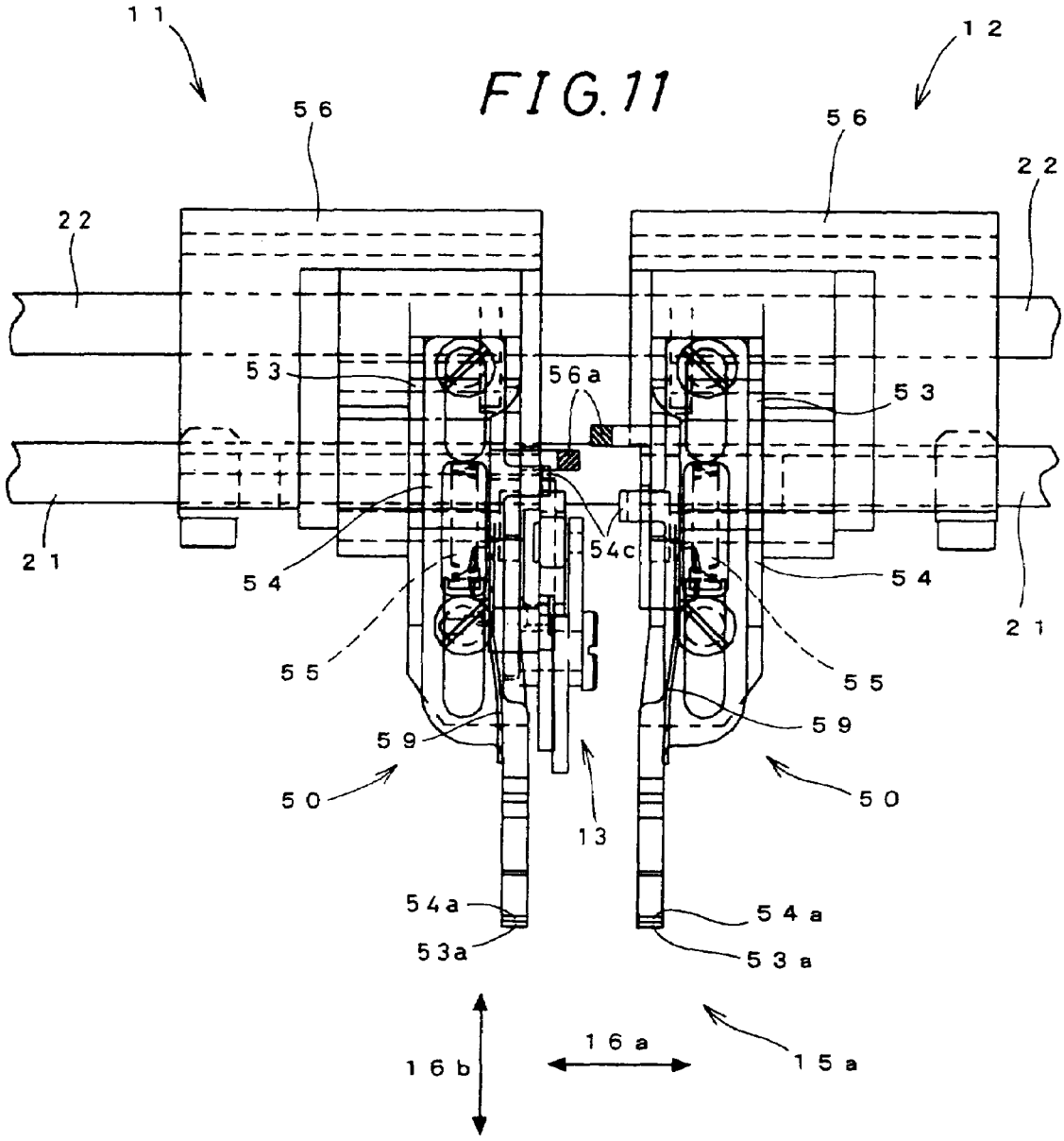
FIG. 11 is a plan view illustrating a state in which a spacing between the first gripper 11 and the second gripper 12 in FIG. 1 is large.
Figure 12:
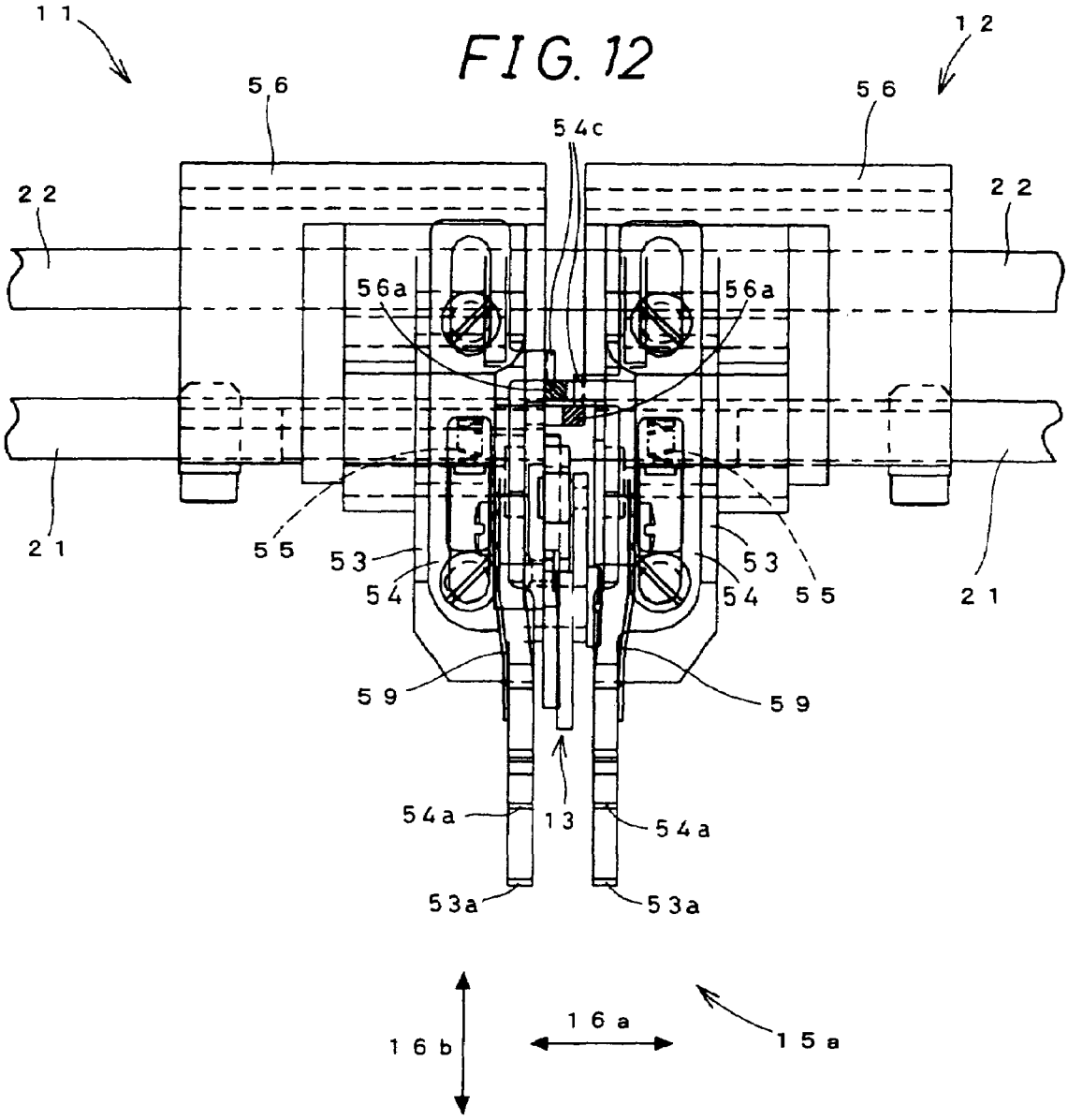
FIG. 12 is a plan view illustrating a state in which a spacing between the first gripper 11 and the second gripper 12 in FIG. 1 is small, so that a press member 54 can be regulated with a stopper 56*a;*

FIGS. 11 and 12 respectively show states in which the regulation on the movement of the press members 54 in the closer and away direction 16*b* is valid and invalid in accordance with the spacing between the first gripper 11 and the second gripper 12. The stopper 56*a* projects on each base 56 toward the other base 56. The positions of the stoppers 56*a* are made different from each other between the first gripper 11 and the second gripper 12 in such a manner that the stoppers 56*a* do not interfere with each other. The positions of the projecting portions 54*c* provided on the press members 54 are also made different from each other in accordance with the positions of the stoppers 56*a*.

FIG. 11 shows a state in which the spacing between the first gripper 11 and the second gripper 12 is larger than a range in which the stoppers 56*a* abut against the projecting portions 54*c* of the press members 54. Each of the press members 54 is pressed by the spring 55 toward each of the hook members 53, and the front end portion of each of the spring-biased grippers 50 is closed. FIG. 12 shows a state in which the first gripper 11 and the second gripper 12 have moved closer to each other until the stoppers 56*a* abut against the projecting portions 54*c* of the press members 54. In a state where the front end portions of the hook members 53 and the press members 54 are closed, when the front end portions move closer to the needle bed gap 15*a* in the closer and away direction 16*b* from the reference positions, which are remotest from the needle bed gap 15*a*, the projecting portions 54*c* of the press members 54 abut against the stoppers 56*a* at a point midway in the movement, and thus the press members 54 are prevented from moving, and only the hook members 53 continuously moves, so that the spacings between the front end portions 53*a* and 54*a* becomes wider.

The first gripper 11 is also provided with the cutter 13. The position at which the cutter 13 performs cutting is the position away from the needle bed gap 15*a* over the position at which the stopper 56*a* prevents the press member 54 from moving closer to the needle bed gap 15*a*. The hook member 53 and the press member 54 can move away in the closer and away direction 16*b* to the position that is away from the needle bed gap 15*a* over the position at which the cutter 13 performs cutting. A yarn guide member 59 for regulating the movement of a knitting yarn and for guiding the knitting yarn to the cut position even when the front end portions 53*a* and 54*a* of the hook member 53 and the press member 54 move away from the cut position, in a state where the knitting yarn is gripped between the front end portions 53*a* and 54*a* of the hook member 53 and the press member 54 is provided next to the hook member 53 and the press member 54. The yarn guide member 59 firmly grips a yarn end after the knitting yarn is cut.

Figure 13:
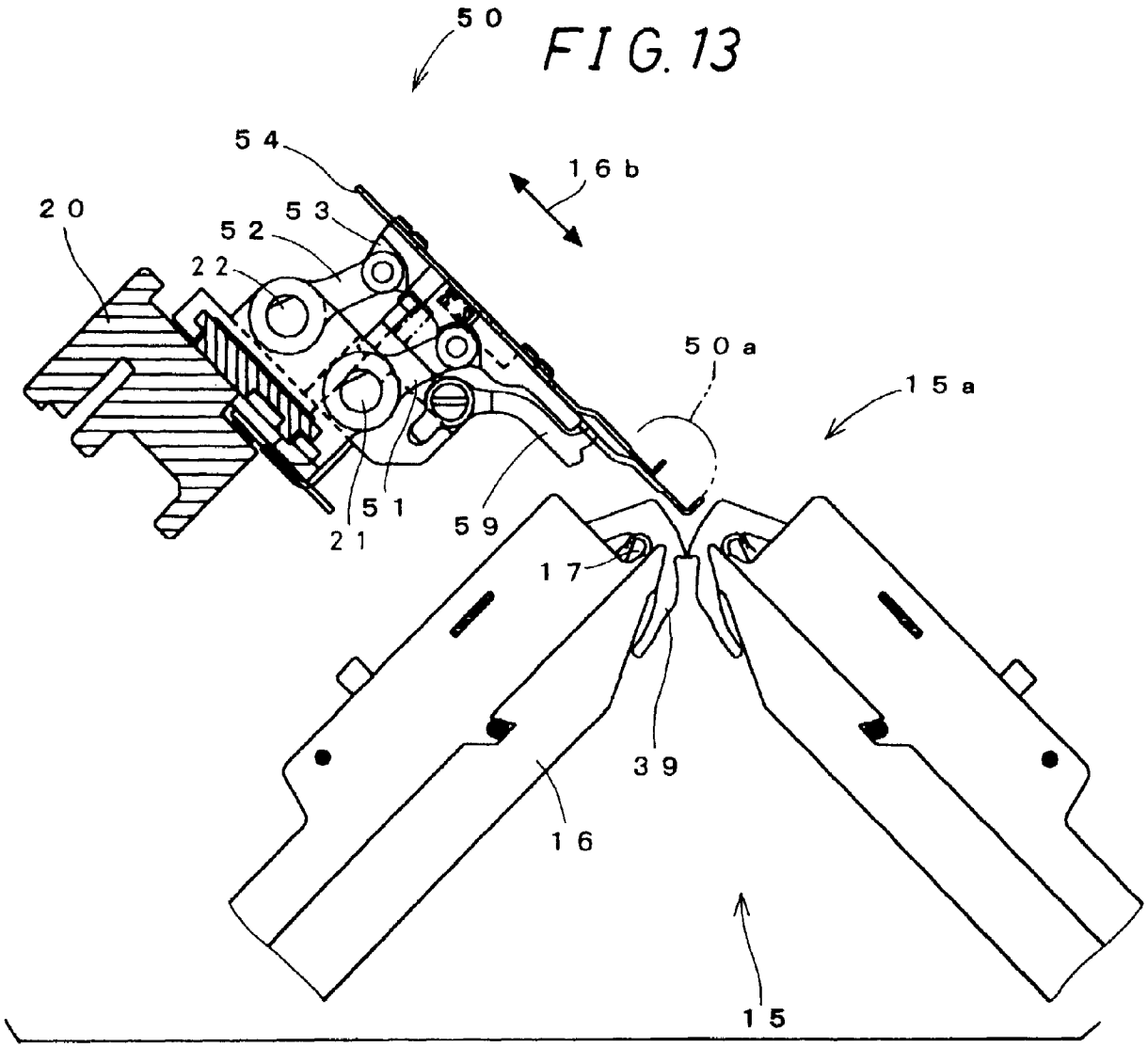
FIG. 13 is a simplified left side view illustrating a locus drawn by the front end portion when the first gripper 11 in FIG. 1 moves closer to and away from the needle bed gap 15*a;*

FIG. 13 shows a locus 50*a* drawn by the front end portion when the spring-biased gripper 50 moves closer to and away from the needle bed gap 15*a*. The hook member 53 forms a parallelogram together with the first link member 51 and the second link member 52, and thus the locus 50*a* is not a straight line in the closer and away direction 16*b*, but is along a curved line in the shape of an arc. Accordingly, when the front end portion moves forward into the needle bed gap 15*a*, the front end portion can move back and forth near the center of the needle bed gap 15*a* so as not to interfere with the front ends of the knitting needles 17 and the sinkers 39 projecting from each of the needle beds 16 toward the needle bed gap 15*a*.

Figure 14:
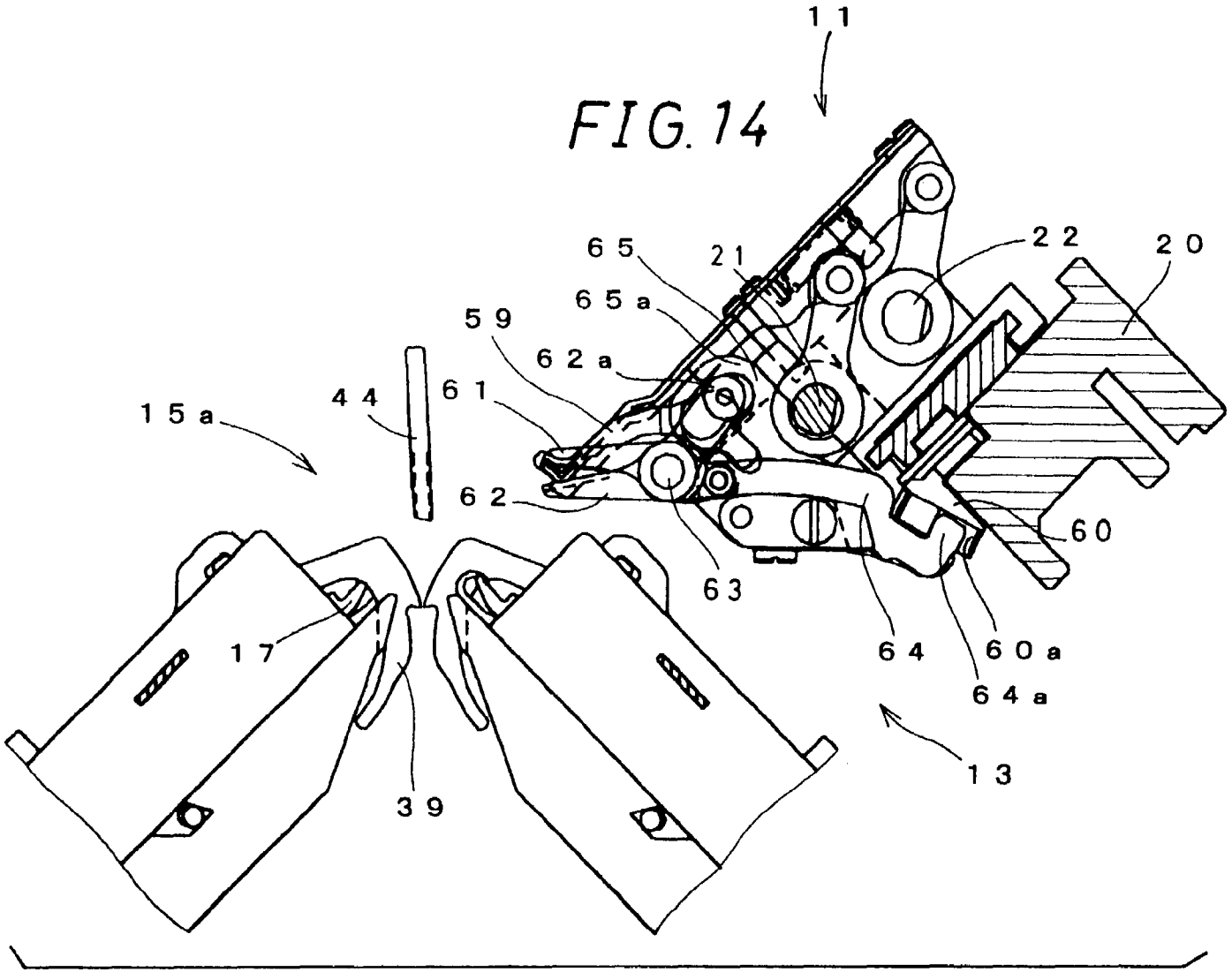
FIG. 14 is a right side cross-sectional view illustrating a state in which the cutter 13 in FIG. 1 is open.
Figure 15:
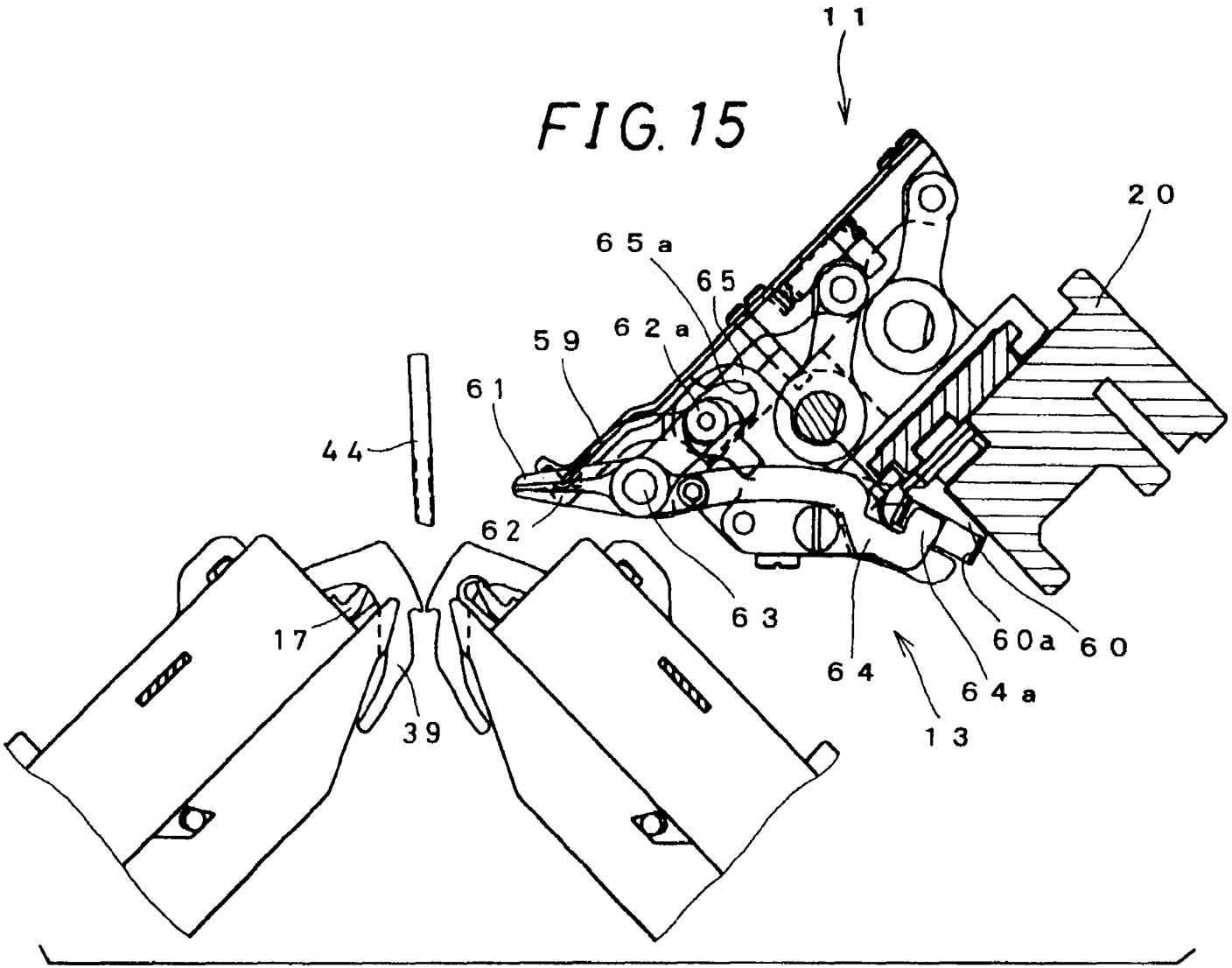
FIG. 15 is a right side cross-sectional view illustrating a state in which the cutter 13 in FIG. 1 is closed.
Figure 16:
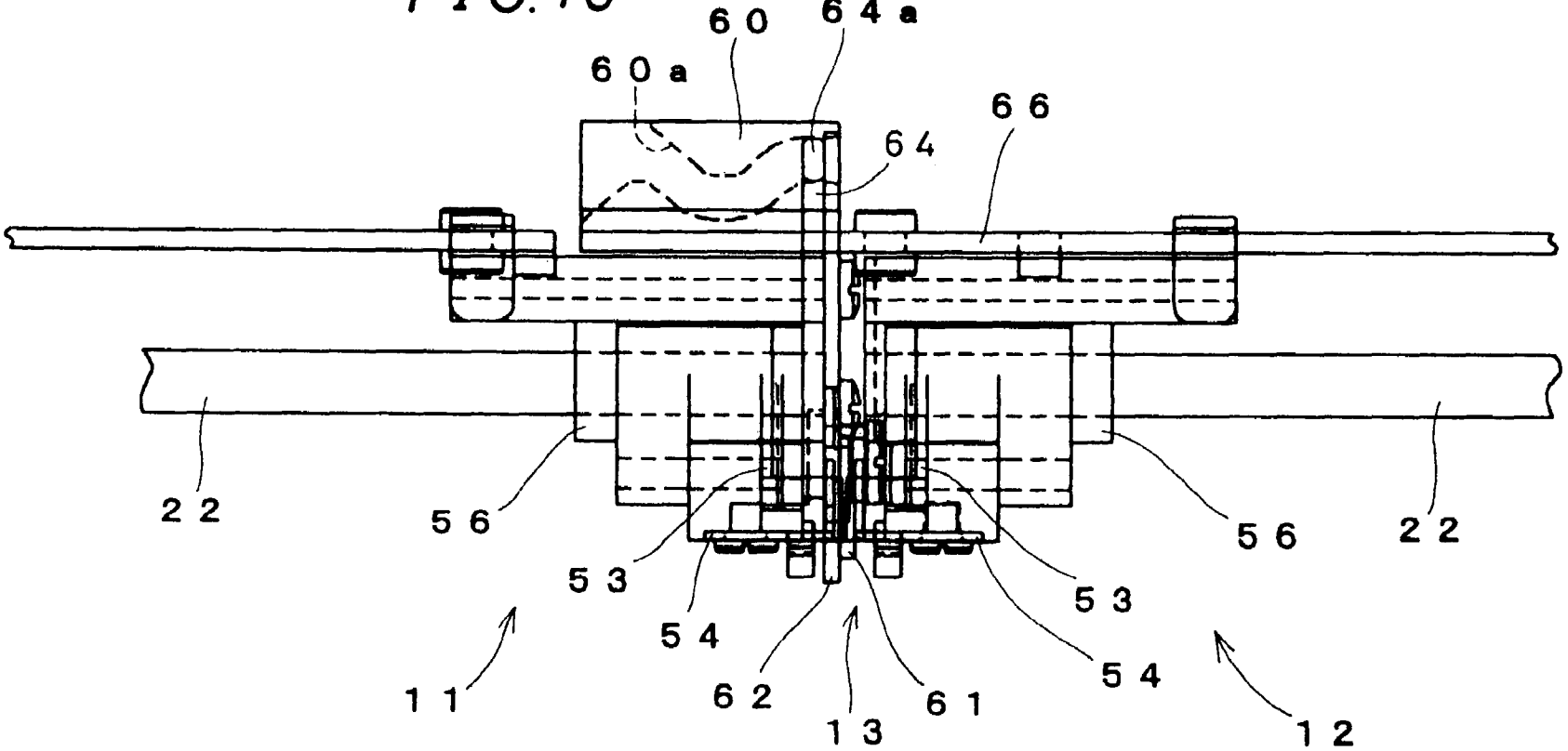
FIG. 16 is a plan view illustrating a state in which the cutter 13 in FIG. 1 is open.
Figure 17:
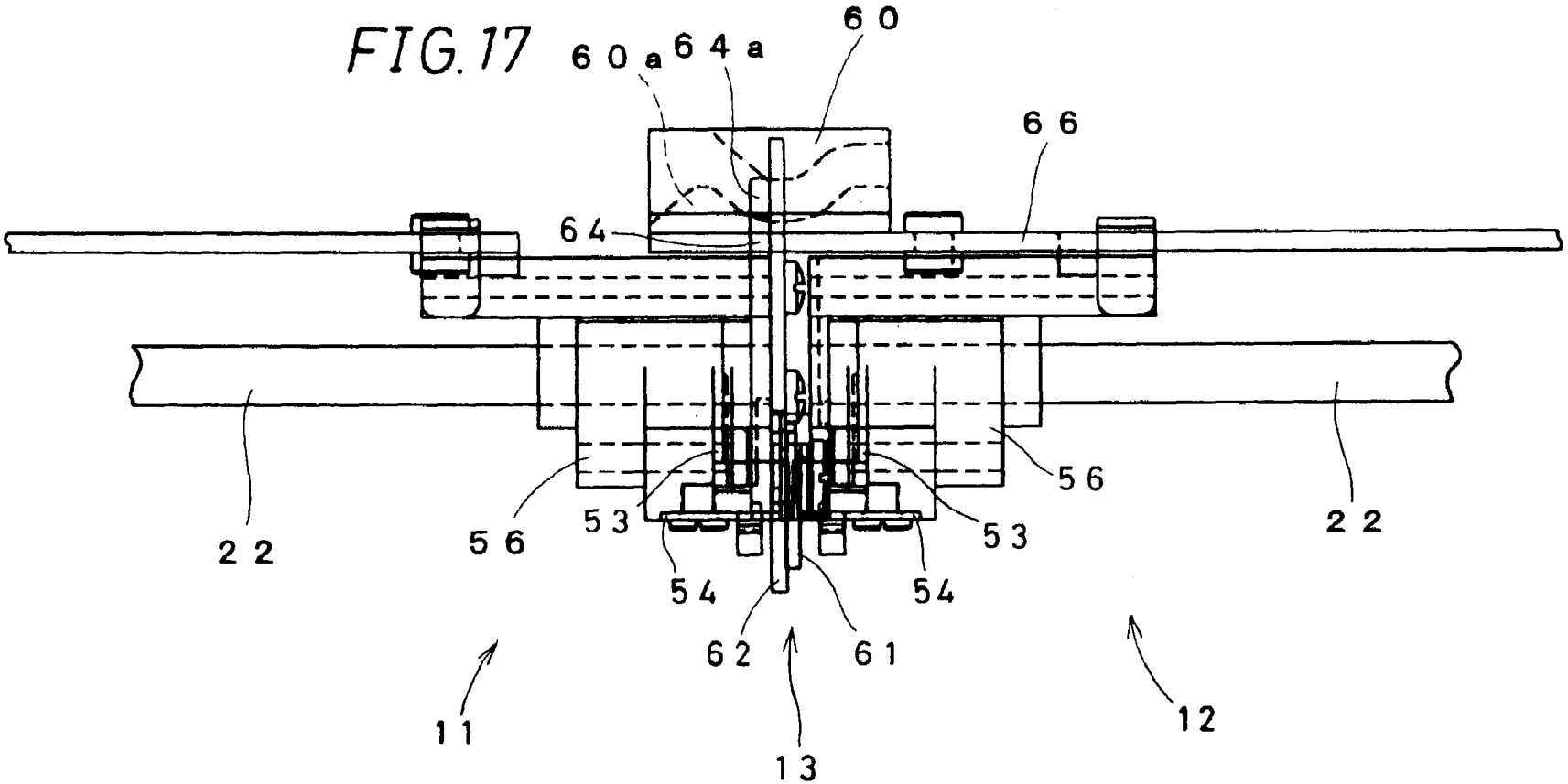
FIG. 17 is a plan view illustrating a state in which the cutter 13 in FIG. 1 is closed.
Figure 18:
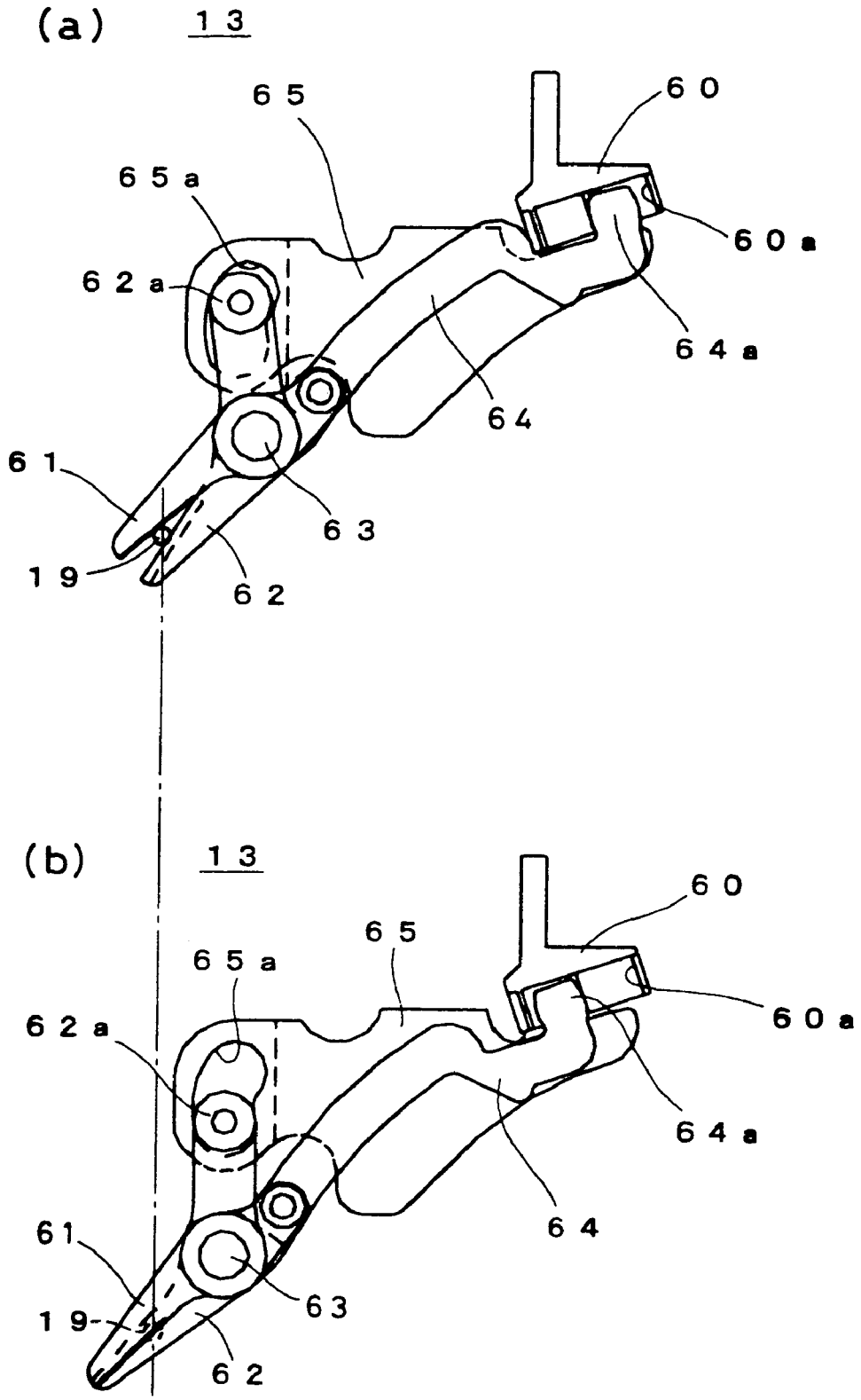
FIG. 18 shows partial side views illustrating an operation of opening and closing the cutter 13 in FIG. 1.

FIGS. 14 to 18 show an operation of the cutter 13. FIGS. 14 and 15 are side cross-sectional views. FIGS. 16 and 17 are plan views. FIG. 18 shows a partial side view of an operation of opening and closing the blade edges of the cutter 13. FIGS. 14 and 16 show states in which the blade edges of the cutter 13 are open. FIGS. 15 and 17 show states in which is the blade edges of the cutter 13 are closed. The cutter 13 cuts a knitting yarn by holding the knitting yarn between an upper blade 61 and a lower blade 62 that are opened and closed by a holding cam 60. The upper blade 61 and the lower blade 62 intersect each other at an intersection shaft 63, and can be swingingly displaced about the intersection shaft 63. One end of a driving member 64 is connected to the end portion of the upper blade 61, on the side over the intersection shaft 63. The other end of the driving member 64 has a follower (butt) 64*a* that is guided by a cam groove 60*a* formed on the holding cam 60. The end portion of the lower blade 62, on the side over the intersection shaft 63, is provided with a follower (roller) 62*a*. The follower (roller) 62*a* is guided by a guide groove 65*a* of a guide member 65.

As shown in FIGS. 16 and 17, while the cutter 13 is provided on the side of the first gripper 11, the holding cam 60, which is a part of a mechanism for operating the cutter 13, is provided on the side of the second gripper 12. The holding cam 60 is connected via a connection plate 66 to the left end of the second chain 28. At the left end of the second chain 28, a drive is performed for moving the base 56 of the second gripper 12, but the connection plate 66 and the holding cam 60 can continuously move leftward even after the base 56 of the second gripper 12 abuts against the base 56 of the first gripper 11 and stops the movement. With this movement, the follower (butt) 64*a* of the driving member 64 that is guided by the cam groove 60*a* of the holding cam 60 extrudes the upper blade 61 such that the upper blade 61 moves closer to a knitting yarn. The lower blade 62 also receives the extruding force via the intersection shaft 63, and both of the upper blade 61 and the lower blade 62 are extruded to be closed. Accordingly, as shown in an enlarged view in FIG. 18, it is possible to reliably cut the knitting yarn 19 that is positioned with the front end of the guide regulation member 59, by holding the knitting yarn 19 between the upper blade 61 and the lower blade 62.

Figure 19:
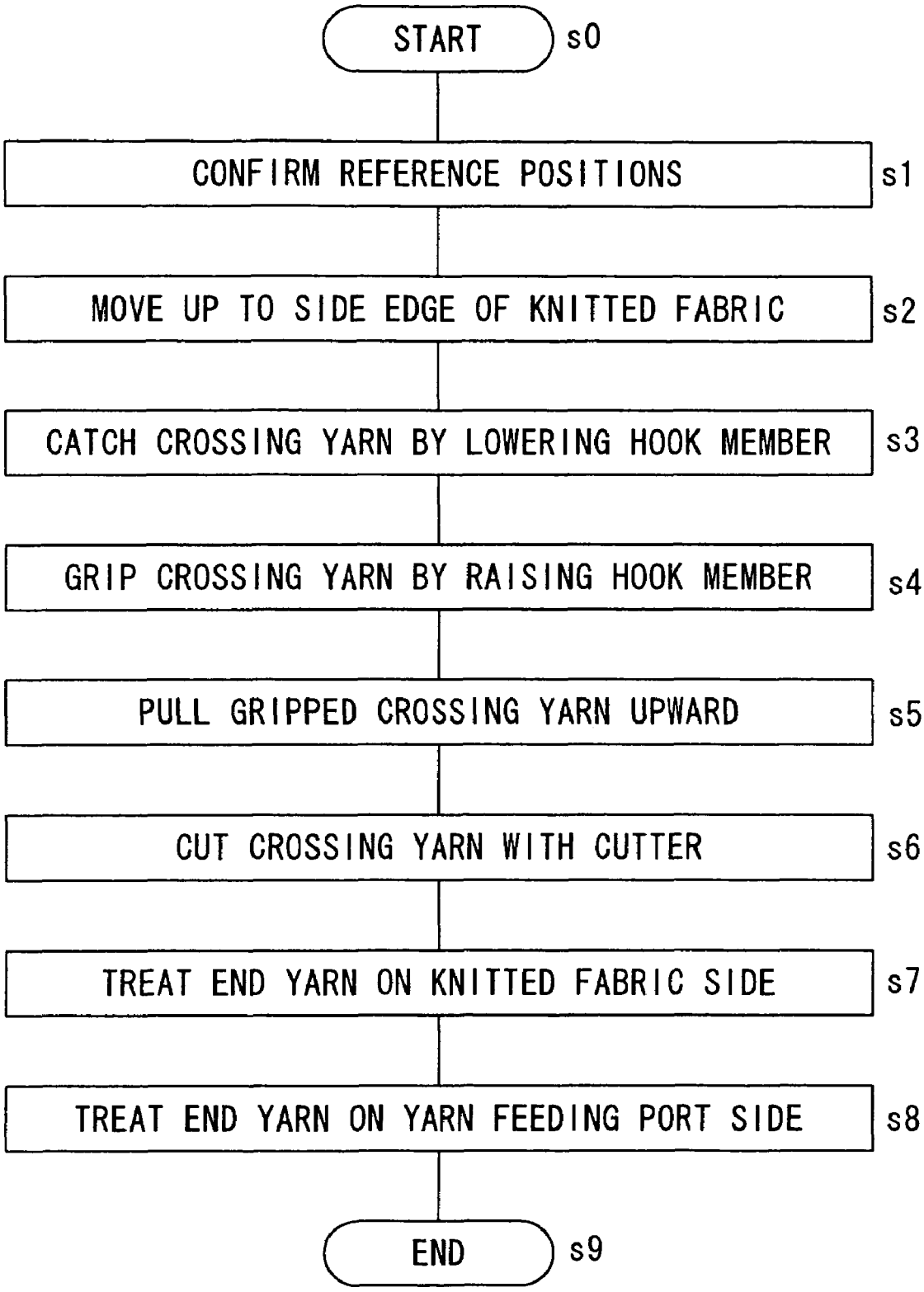
FIG. 19 is a flowchart showing a procedure outline in which the end yarn treatment apparatus 10 in FIG. 1 grips and cuts a knitting yarn 19 and treats end yarns.

FIG. 19 shows a procedure outline in which the end yarn treatment apparatus 10 grips and cuts the knitting yarn 19 and treats the end yarns. The procedure starts at step s0, and it is confirmed that the first gripper 11 and the second gripper 12 are at the reference positions in step s1. The reference positions are at the right end as shown in FIG. 3, for example; and the state is such that the hook member 53 and the press member 54 of the spring-biased gripper 50 have moved away from the needle bed gap 15*a* to the extent possible. In step s2, the first movement motor 23 and the second movement motor 24 are driven, and thus the first gripper 11 and the second gripper 12 are moved to the side edge of the knitted fabric on which the end yarn treatment is performed. In step s3, in a state where the knitting of the knitted fabric using the knitting yarn 19 is halted and a portion that becomes a crossing yarn is generated, the first rotation motor 25 and the second rotation motor 26 are driven, and thus the hook members 53 are moved closest to the needle bed gap 15*a*. The press members 54 follow up to a point midway in the movement, but the press members 54 are then regulated with the stoppers 56*a*, and only the hook members 54 move closer to the needle bed gap 15*a*. The knitting yarn 19 that becomes a crossing yarn is caught at the front end portions 53 of the hook members 53.

In step s4, a drive is performed such that the first rotation motor 25 and the second rotation motor 26 are rotated in reverse and the hook members 53 are moved away from the needle bed gap 15*a*. The front end portions 53*a* of the two hook members 53 catch the knitting yarn 19 with a spacing interposed therebetween, and move closer to the front end portions 54*a* of the press members 54 that are retained with the stoppers 56*a*. When the hook members 53 are continuously moved away from the needle bed gap 15*a* further, the knitting yarn 19 that is caught at the front end portions 53*a* of the hook members 53 is gripped by being held between the front end portions 53*a* of the hook members 53 and the front end portions 54*a* of the press members 54. The regulation by the stoppers 56*a* on the press members 54 acts on the side moving closer to the needle bed gap 15*a* and does not act on the side moving away from the needle bed gap 15*a*. Thus, when the drive is further continued, in step s5, the knitting yarn 19 that is gripped between the front end portions 53*a* and 54*a* of the hook members 53 and the press members 54 can be pulled upward over the position at which the cutter 13 performs cutting. It should be noted that the knitting yarn 19 is guided by the guide regulation member 59 to the cut position and is regulated so as not to be pulled upward higher than the cut position.

In step s6, the holding cam 60 is moved from the state shown in FIG. 16 to the state shown in FIG. 17, and the knitting yarn 19 is cut with the cutter 13. The knitting yarn 19 is gripped on both sides of the position at which the cutter 13 performs cutting, by the spring-biased grippers 50 of the first gripper 11 and the second gripper 12, and thus the knitting yarn 19 is not left without any treatment after the cutting, but is held as the end yarns. In step s7, the end yarn on the side of the knitted fabric is treated by moving one gripper on the side of the knitted fabric, among the first gripper 11 and the second gripper 12, independently of the other gripper in the longitudinal direction 16*a*, and when necessary, by moving the one gripper also in the closer and away direction 16*b*. In step s8, the end yarn on the side of the yarn feeding port 44 is treated with the other gripper among the first gripper 11 and the second gripper 12. The procedure ends at step s9.

Figure 20:
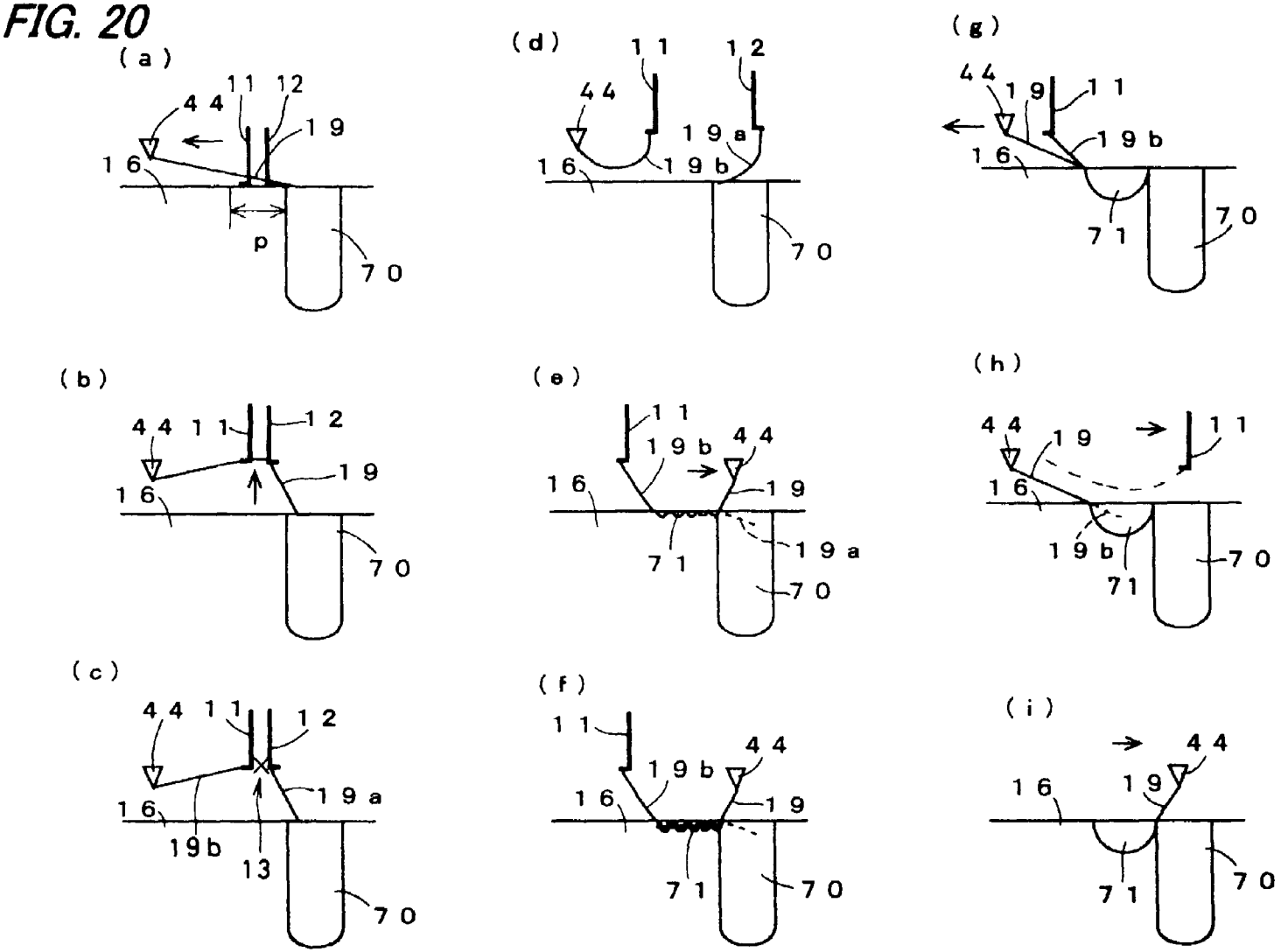
FIG. 20 shows views illustrating the outline of the treatment on end yarns 19*a* and 19*b* performed by the end yarn treatment apparatus 10 in FIG. 1.

FIG. 20 shows the treatment from step s2 to step s8 in FIG. 19 in a case where finger pockets of a knitted fabric of a glove are knitted. FIG. 20(*a*) shows a state in which knitting of one finger pocket 70 has been ended. On the needle bed 16 holding the finger pocket 70, the next finger pocket is knitted at a width p portion that is adjacent to the finger pocket 70. The yarn feeding port 44 moves away from the knitting needles on the needle bed 16 holding the finger pocket 70 together with the knitting yarn 19. The first gripper 11 and the second gripper 12 move closer to the needle bed gap in a state where the grippers are open, and the knitting yarn 19 crosses thereover. FIG. 20(*b*) shows a state in which the first gripper 11 and the second gripper 12 catch, pull upward, and grip the knitting yarn 19. FIG. 20(*c*) shows a state in which the knitting yarn 19 is cut with the cutter 13 at the middle of the gripped portions, and thus an end yarn 19*a* is generated on the side of the finger pocket 70, which is the knitted fabric, and an end yarn 19*b* is generated on the side of the yarn feeding port 44. FIG. 20(*d*) shows a state in which the second gripper 12 gripping the end yarn 19*a* on the side of the knitted fabric is moved, and thus the end yarn 19*a* is inserted into the finger pocket 70. The insertion can be reliably performed by moving the second gripper 12 along an opening of the finger pocket 70 and also by moving the second gripper 12 closer to and away from the needle bed gap.

FIG. 20(*e*) shows a state in which while keeping a state in which the end yarn 19*b* on the side of the yarn feeding port 44 is gripped with the first gripper 11, the yarn feeding port 44 is moved and knitting of a next finger pocket 71 is started. The end yarn 19*a* on the side of the knitted fabric is pulled out from between the front end portions 53*a* and 54*a*, with a tensile force generated by moving the second gripper 12, against a gripping force between the front end portions 53*a* and 54*a* of the hook member 53 and the press member 54, and is retained inside the finger pocket 70. In the state of FIG. 20(*b*), when the length, to the knitted fabric, of the knitting yarn 19 that is gripped with the second gripper 12 on the side of the knitted fabric is made short, it is possible to easily insert the end yarn 19*a* into the finger pocket 70.

FIGS. 20(*f*) to 20(*g*) show a state in which knitting of the next finger pocket 71 is started. FIG. 20(*h*) shows a state in which the first gripper 11 is moved such that the front end portion forms a locus as indicated by the broken line, and the end yarn 19*b* is inserted into the next finger pocket 71 that has started to be knitted. FIG. 20(*i*) shows a state in which knitting of the finger pocket 71 proceeds and the end yarn 19*b* is absorbed into the knitted fabric.

As described above, the end yarn treatment apparatus 10 of this embodiment includes the first gripper 11, the second gripper 12, the cutter 13, and the control means 14 in order to cut the knitting yarn 19 and to treat the end yarns 19*a* and 19*b* that are generated by the cutting in knitting a fabric with the weft knitting machine 15. Both of the first gripper 11 and the second gripper 12 can move in the longitudinal direction 16*a* along the needle beds 16 of the weft knitting machine 15 and in the closer and away direction 16*b* in which the grippers move closer to and away from the needle beds 16, and can switch between a state in which the knitting yarn 19 is not gripped and a state in which the knitting yarn 19 is gripped. The first gripper 11 and the second gripper 12 can move independently of each other. The cutter 13 can move along the needle beds 16 of the weft knitting machine 15, and can switch between a state in which the knitting yarn 19 is cut and a state in which the knitting yarn 19 is not cut. The control means 14 controls the movement and the switching of the states of the first gripper 11, the second gripper 12, and the cutter 13, and performs a control such that in a state where the knitting yarn 19 is gripped with the first gripper 11 and the second gripper 12, the gripped knitting yarn 19 is cut with the cutter 13. The knitting yarn 19 is cut with the cutter 13 in a state where both sides of the cut portion are gripped with the first gripper 11 and the second gripper 12. Thus, even when the knitting yarn 19 is a hard yarn, for example, the blades do not slip and the knitting yarn 19 can be reliably cut. The end yarns 19*a* and 19*b* that are generated by cutting the knitting yarn 19 with the cutter 13 are gripped on both sides of the cutter 13 respectively with the first gripper 11 and the second gripper 12. Thus, the end yarns are not left without any treatment after the cutting. The first gripper 11 and the second gripper 12 can be moved independently of each other in the direction along the needle beds 16 and in the direction in which the grippers move closer to and away from the needle beds. Thus, the grippers can be moved such that the end yarns 19*a* and 19*b* are respectively gripped, moved at an appropriate timing in accordance with the knitting operation of the knitted fabric, and stably absorbed into the knitted fabric. Accordingly, it is possible to reliably catch and cut a crossing yarn generated in knitting a fabric, and to appropriately treat the end yarns 19*a* and 19*b* after the cutting.

Furthermore, in the end yarn treatment apparatus 10, the cutter 13 is provided on the first gripper 11. Thus, the cutter 13 and the first gripper 11 can be moved at the same time, so that it is possible to simplify the configuration for the movement. The second gripper 12 is provided with the holding cam 60 as at least a part of the driving mechanism for operating the cutter 13 so as to cut the knitting yarn 19. Thus, the first gripper 11 and the second gripper 12 in cooperation with each other can operate the cutter 13 provided on the first gripper 11. When the first gripper 11 and the second gripper 12 are away from each other, it is impossible to form the driving mechanism, and thus it is possible not to cut the knitting yarn 19. It goes without saying that the cutter 13 may be made capable of moving independently of the first gripper 11 and the second gripper 12.

Furthermore, both of the first gripper 11 and the second gripper 12 are taken as the spring-biased grippers 50, but it is also possible to take only one side. An actuator for opening and closing the gripper may be mounted on the other side. In an end yarn treatment method for cutting the knitting yarn 19 and for treating the end yarns 19*a* and 19*b* that are generated by the cutting in knitting a fabric with the weft knitting machine 15 as in the invention, instead of the cutter and one of the grippers, it is also possible to use a yarn cutting and gripping apparatus provided below the needle bed gap 15*a*, which has been referred to in Japanese Patent No. 3347079, for example. As long as both sides of a portion at which a knitting yarn is cut can be held, the invention is applicable with any configuration used as the configuration for holding and cutting. Even after the cutting, when end yarns generated after the cutting are held and treated so as to be absorbed into the knitted fabric independently of each other, it is possible to perform a reliable treatment for the end yarns.

Figure 21:
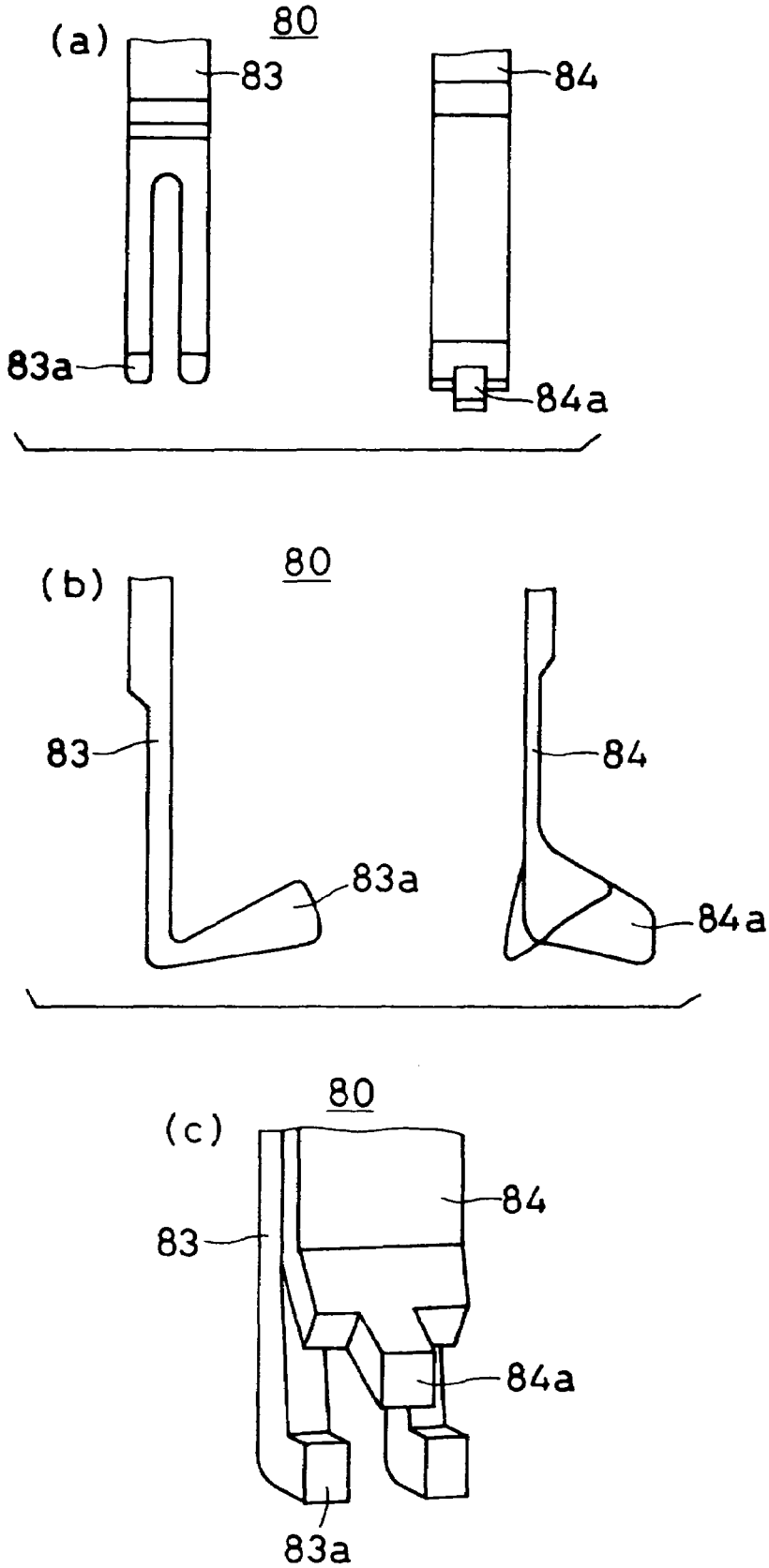
FIG. 21 shows a partial front view, left side view, and perspective view illustrating the shape of a front end portion of a spring-biased gripper 80, which is another embodiment of the invention.
Figure 22:
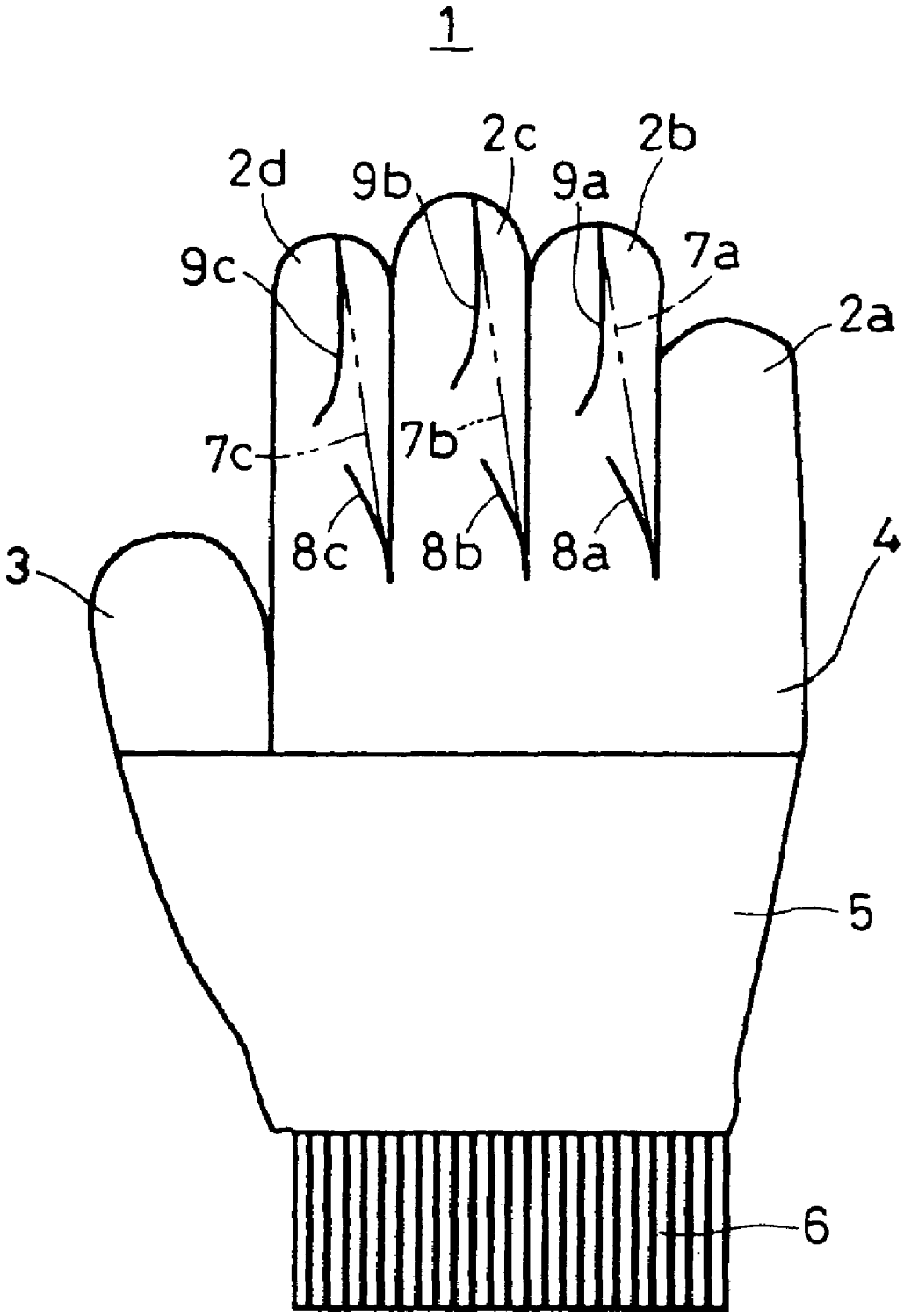
FIG. 22 is a view illustrating a conventional configuration of a knitted fabric of a glove 1.

As another embodiment of the invention, FIG. 21 shows an example of the shape of the front end portion of a spring-biased gripper 80 that is similar to the spring-biased gripper 50 shown in FIG. 13. The configuration of the other components is as in the spring-biased gripper 50. FIG. 21(*a*) shows a front view of front end portions 83*a* and 84*a* of a hook member 83 and a press member 84 arranged side by side. FIG. 21(*b*) shows a left side view of the front end portions 83*a* and 84*a* of the hook member 83 and the press member 84 arranged side by side. FIG. 21(*c*) shows a perspective view of a state in which the front end portions of the first gripper 11 and the second gripper 12 constituted by the front end portion 83 of the hook member 83 and the front end portion 84*a* of the press member 84 are slightly open.

It is necessary that the first gripper 11 and the second gripper 12 in FIG. 1 reliably grip a knitting yarn. Furthermore, there is a case in which a plurality of knitting yarns are knitted at the same time, for example, in plating. In addition, there is a case in which characteristics are different between a plurality of knitting yarns. For example, there is also a case in which a thick yarn and an elasticized thin yarn made of polyurethane or other materials for knitting a fabric are provided in a mixed manner. Even when knitting yarns with different characteristics are provided in a mixed manner, in order to reliably hold the knitting yarns, the front ends of the spring-biased gripper 80 in this embodiment are made such that one side such as the front end portion 83*a* of the hook member 83 is in the shape of a two-pronged fork and the front end portion 84*a* of the press member 84, which is the other side, has the shape that is fitted into the middle between the two prongs. Various other shapes are conceivable as the shape of the front end portions that reliably grip a knitting yarn. When the front end portions are made to have the shape with which gripped knitting yarns are not likely to slip, it is possible to reliably grip knitting yarns even when knitting yarns with different characteristics are provided in a mixed manner.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

INDUSTRIAL APPLICABILITY

According to the invention, in a state where a knitting yarn is gripped with a first gripper and a second gripper, the gripped knitting yarn is cut with a cutter. Thus, even when the knitting yarn is a hard yarn, for example, the blades of the cutter do not slip and the knitting yarn can be reliably cut. The end yarns that are generated by cutting the knitting yarn with the cutter are respectively gripped on both sides of the cutter with the first gripper and the second gripper. Thus, the end yarns are not left without any treatment after the cutting, and can be stably absorbed into the knitted fabric with the first gripper and the second gripper that can be moved independently of each other. Accordingly, it is possible to reliably catch and cut a crossing yarn that is generated in knitting a fabric, and to appropriately treat end yarns after the cutting.

Furthermore, according to the invention, the cutter is provided on the first gripper. Thus, the cutter and the first gripper can be moved at the same time, so that it is possible to simplify the configuration for the movement. The second gripper is provided with at least a part of a driving mechanism for operating the cutter so as to cut a knitting yarn. Thus, the first gripper and the second gripper in cooperation with each other can operate the cutter provided on the first gripper. When the first gripper and the second gripper are away from each other, it is impossible to form the driving mechanism, and thus it is possible not to cut the knitting yarn.

Furthermore, according to the invention, at least one of the first gripper and the second gripper is provided with a spring-biased gripper mechanism, where an end yarn is caught at a front end portion of a hook member and is pressed with a press member to which a force is applied by a spring such that the end yarn is held and gripped by the press member together with the front end portion of the hook member. The end yarn that has been gripped once can be continuously gripped with the force applied by the spring, and a displacement mechanism can move the position at which the end yarn is gripped closer to and away from the needle bed gap of the needle beds.

When the end yarn is knitted into the knitted fabric, and a tensile force applied to the end yarn becomes greater than a holding force for holding the end yarn between the front end portion of the hook member and the press member, it is possible to cancel the gripping of the end yarn.

Furthermore, according to the invention, when the first gripper and the second gripper have moved closer to each other within a range of a predetermined distance, a stopper prevents the press member on the opposed side from moving closer to the position at which a knitting yarn is fed to the needle bed gap of the needle beds. Thus, the displacement mechanism can move only the hook member closer to the needle bed gap of the needle beds against a force applied by the spring, so that the front end portion can catch a knitting yarn that becomes a crossing yarn. When the first gripper and the second gripper are away from each other more than the range, the stopper does not prevent the press member on the opposed side, and the hook member moves closer to and away from the needle bed gap in a state where the front end portion of the hook member is pressed by the press member. Thus, it is possible to perform the treatment by moving the caught knitting yarn that becomes end yarns closer to the needle bed gap while keeping a state in which the knitting yarn is gripped and by moving the knitting yarn in the longitudinal direction of the needle beds. Only with the two types of drives for the movement and the closer/away movement, it is possible to open and close the front ends of the hook members and the front ends of the press members by using the movement of the first gripper and the second gripper closer to and away from each other.

Furthermore, according to the invention, a pair of guide paths are provided in order to guide the movement of the first gripper and the second gripper along the needle beds, and a driving force for the movement in the direction in which the grippers move closer to and away from the needle bed gap of the needle beds can be transmitted to each of the first gripper and the second gripper with an angular displacement about an axis of one and the other guide paths. It is not necessary to mount a driving source on the first gripper and the second gripper, and thus it is possible to make the grippers smaller and lighter.

Furthermore, according to the invention, in knitting a fabric with the weft knitting machine, the cutter cuts a knitting yarn that is gripped on both sides with the two grippers, and the grippers respectively treat the end yarns generated after the knitting yarn is cut with the cutter such that the end yarns are absorbed into the knitted fabric independently of each other. Thus, it is possible to reliably catch and cut a crossing yarn generated in knitting a fabric, and to appropriately treat end yarns after the cutting.

Furthermore, according to the invention, a knitting yarn is caught and gripped only when the two grippers have moved closer to each other within a range of a predetermined distance. Thus, the cutting can be reliably performed in a state where the both sides of the knitting yarn are gripped, by setting a distance appropriate for the cutting performed by the cutter.

Furthermore, according to the invention, a knitting yarn is cut by operating the cutter only when the two grippers grip the knitting yarn. Thus, it is possible to reliably cut a knitting yarn with the cutter.

The invention claimed is:

1. An end yarn treatment apparatus of a weft knitting machine, for cutting a knitting yarn and for treating end yarns generated by cutting when front and rear needle beds face each other in the weft knitting machine and a fabric is knitted by letting knitting needles move back and forth, comprising:

a first gripper that can move in a direction along needle beds of a weft knitting machine and in a direction in which the first gripper moves closer to and away from a needle bed gap of the needle beds, and that can switch between a state in which a knitting yarn is not and a state in which a knitting yarn is gripped;

a second gripper that can move independently of the first gripper in a direction along the needle beds of the weft knitting machine and in a direction in which the second gripper moves closer to and away from the needle beds, and that can switch between a state in which a knitting yarn is not gripped and a state in which a knitting yarn is gripped;

a cutter that can move along the needle beds of the weft knitting machine, and that can switch between a state in which a knitting yarn is cut and a state in which a knitting yarn is not cut; and control means for controlling movement and switching of the states of the first gripper, and the second gripper and the cutter, and for performing a control such that in a state where a knitting yarn is gripped with the first gripper and the second gripper, the knitting yarn between gripped points is cut with the cutter.

2. The end yarn treatment apparatus of claim 1, wherein the cutter is provided on the first gripper, and the second gripper is provided with at least a part of driving mechanism for operating the cutter so as to cut a knitting yarn.

3. The end yarn treatment apparatus of claim 1, wherein at least one gripper among the first gripper and the second gripper is provided with a spring-biased gripper mechanism, comprising:

a hook member whose front end portion catches and hooks a knitting yarn extending from a knitted fabric, a press member for pressing a knitting yarn hooked on the hook member such that the knitting yarn is held and gripped with the press member together with the front end portion of the hook member, a spring for applying a force such that the press member is pressed toward the front end portion of the hook member, and a displacement mechanism for displacing the hook member in a direction in which the hook member moves closer to and away from the needle bed gap of the needle beds.

4. The end yarn treatment apparatus of claim 3, wherein, among the first gripper and the second gripper, the other gripper than the one gripper provided with the spring-biased gripper mechanism, is provided with a stopper for preventing the press member on a side opposed to the stopper on one side from moving closer to a position at which a knitting yarn is fed to the needle bed gap of the needle beds when the first gripper and the second gripper have moved closer to each other within a range of a predetermined distance.

5. The end yarn treatment apparatus of claim 1, wherein a pair of guide paths that are provided in parallel with each other along the needle bed gap of the needle beds and that guide movement of the first gripper and the second gripper along the needle beds, are provided, and one guide path and the other guide path among the pair of guide paths respectively drive the first gripper and the second gripper for movement in a direction in which the grippers move closer to and away from the needle bed gap of the needle beds with an angular displacement about an axis.

6. An end yarn treatment method of a weft knitting machine, for cutting a knitting yarn and for treating end yarns generated by cutting in knitting a fabric with the weft knitting machine, comprising:

gripping both sides of a portion at which a knitting yarn is to be cut with a cutter, with two grippers; and treating end yarns generated after a knitting yarn is cut with the cutter by the grippers such that the end yarns are absorbed into a knitted fabric independently of each other.

7. The end yarn treatment method of claim 6, wherein a knitting yarn is caught and gripped only when the two grippers have moved closer to each other within a range of a predetermined distance.

8. The end yarn treatment method of claim 6, wherein a knitting yarn is cut by operating the cutter only when the two grippers grip the knitting yarn.

* * * * *